US005193591A

United States Patent [19]

Nicolini

[11] Patent Number: 5,193,591

[45] Date of Patent: Mar. 16, 1993

[54] MECHANISM FOR FORMING A RECESSED SELVEDGE ON A SHUTTLELESS LOOM

[75] Inventor: Antonio Nicolini, Schio, Italy

[73] Assignee: Cem Italia S.r.l, Vicenza, Italy

[21] Appl. No.: 688,142

[22] Filed: Apr. 22, 1991

[30] Foreign Application Priority Data

Apr. 20, 1990 [IT] Italy ..... 20104 A/90

[51] Int. Cl.[5] ..... D03D 47/48

[52] U.S. Cl. ..... 139/434

[58] Field of Search ..... 139/434, 194

[56] References Cited

U.S. PATENT DOCUMENTS

| | | | |
|---|---|---|---|
| 3,425,461 | 2/1969 | Berry | 139/434 |
| 3,951,177 | 4/1976 | Santucci | 139/434 |
| 4,076,049 | 2/1978 | Manea | 139/434 |
| 4,848,415 | 7/1989 | Manea | 139/434 |

*Primary Examiner*—Andrew M. Falik

*Attorney, Agent, or Firm*—Cushman Darby & Cushman

[57] ABSTRACT

A selvedge-forming mechanism for forming a recessed selvedge in a fabric produced by a shuttleless loom includes elements for gripping and cutting the pick inserted into the shed, a needle which captures the tail of the cut pick and causes the tail to enter again, in a bent-back, i.e., doubled-back condition, in the shed. The shed closes onto the bent-back, cut pick, thereby providing the recessed selvedge. The mechanism also includes a respective kinematic drive for performing the gripping and cutting, and for the needle. The drive kinematic drive includes a first side carriage and a second side carriage, these side carriages being disposed opposite to each other and having the gripping elements and cutting elements installed on them, and a third, central carriage on which the needle is installed. The three carriages are driven to reciprocate by respective cams, which directly act on them, with only the interposition of respective cam followers.

4 Claims, 31 Drawing Sheets

MECHANISM FOR FORMING A RECESSED SELVEDGE ON A SHUTTLELESS LOOM

BACKGROUND OF THE INVENTION

The present invention relates to an improved selvedge-forming mechanism, capable of forming a recessed selvedge in a fabric manufactured by means of a shuttleless loom.

Selvedge-forming mechanisms of this type are known, which comprise gripping means and cutting means for the pick inserted inside the shed, and a needle which captures the so-said tail of the cut pick, and causes the cut pick to enter the shed again, in a bent condition, which closes onto the bent cut pick, thus realizing the recessed selvedge.

Selvedge-forming mechanisms of this type are well-known to those skilled in the art, and are disclosed and illustrated, e.g., in U.S. Pat. Nos. 3,951,177 and 4,076,049, to which the reader is referred, in case any clarifications are necessary.

However, the selvedge-forming mechanisms known from the prior art are only suitable for operating on looms operating with a relatively low revolution speed (rpm); in fact, difficulties arise when one tries to install such prior art mechanisms on more modern looms, which operate at very high revolution speeds, of approximately 600 rpm, and even more.

The reason for this lack of adaptability of the selvedge-forming mechanisms known from the prior art to very fast looms depends on the matter of fact that, in the selvedge-forming mechanisms known from the prior art, the pick-gripping/cutting means, as well as the needle, are driven by kinematic systems based on cans and levers which not only are very complex, but are also relatively cumbersome, and consequently uncapable of correctly operating at the required speeds.

SUMMARY OF THE INVENTION

The general purpose of the present invention is to obviate the drawbacks of the systems known from the prior art, by providing a very compact selvedge-forming mechanism, in which the pick-gripping/cutting means, and the needle, are driven by means of respective kinematic links based on cams and lever systems of very simple structure, and without the complex systems for operating connection with the motion source shaft.

That purpose is achieved according to the present invention by providing a selvedge-forming mechanism for forming a recessed selvedge in a fabric manufactured on a shuttleless loom, of the type comprising, in combination: means for gripping and cutting the thread inserted inside the shed, a needle which captures the tail of the cut pick and causes il to enter back, in a bent-back, i.e., doubled-back condition, into the shed, which closes on it, thus providing the recessed selvedge. The present invention further provides respective kinematic drive means for the gripping/cutting means and for the needle. The kinematic drive means comprise a first side carriage and a second side carriage, mutually opposite, on which the gripping means and cutting means are installed, and a third, central carriage on which the needle is installed, the carriages being driven to reciprocate by means of respective cams, which directly act on them, with the only interposition of a respective cam-follower.

BRIEF DESCRIPTION OF THE DRAWINGS

The structural and functional characteristics of the invention, and the advantages thereof over the prior art will be understood in a still clearer way from the following description, made by referring to the accompanying schematic drawings, which show an example of a form of practical embodiment of selvedge-forming mechanism, constructed according to the principles of the present invention.

In the drawings.

DETAILED DESCRIPTION

Figure 1:
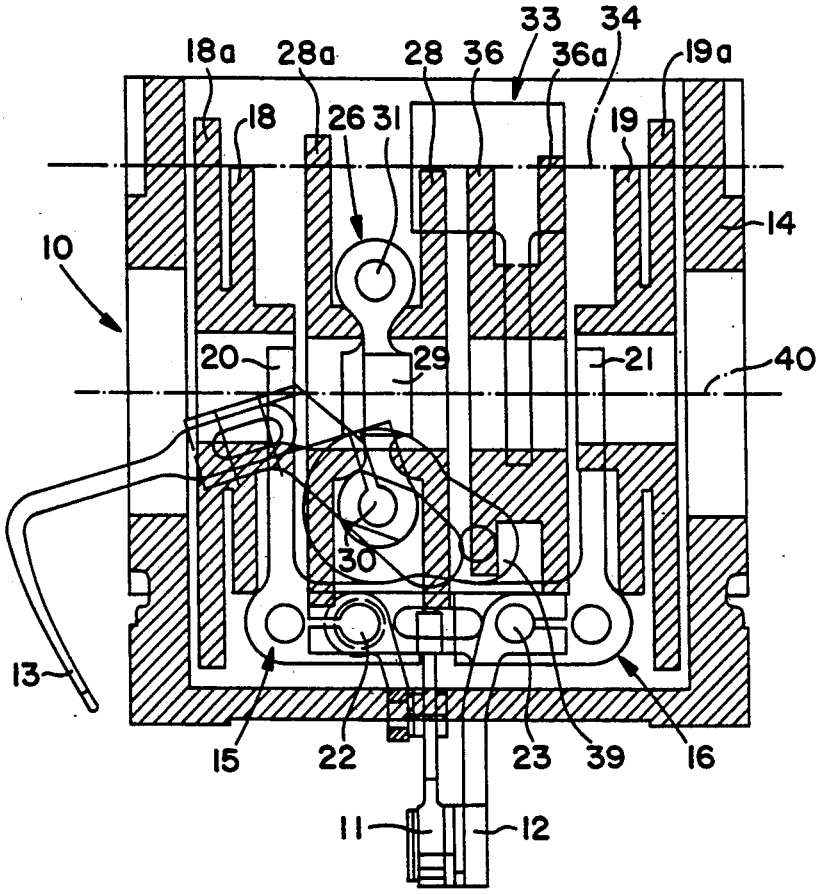
FIGS. 1, 2 and 3 show vertical transversal sectional, vertical longitudinal sectional and horizontal cross-sectional views respectively, illustrating the whole selvedge-forming mechanism, in its non-operating position (i.e., in its cycle-beginning position)
Figure 2:
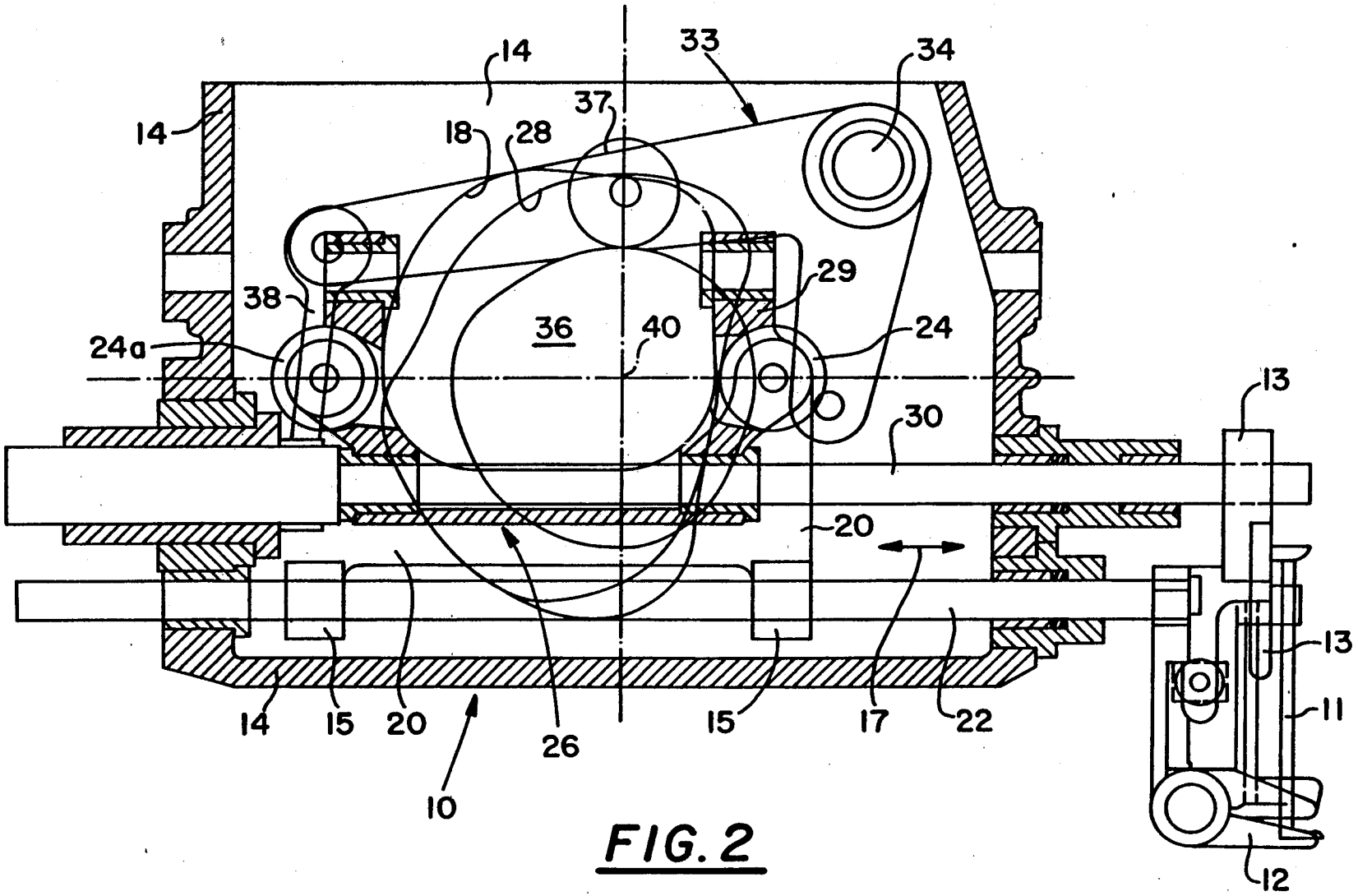
Figure 3:
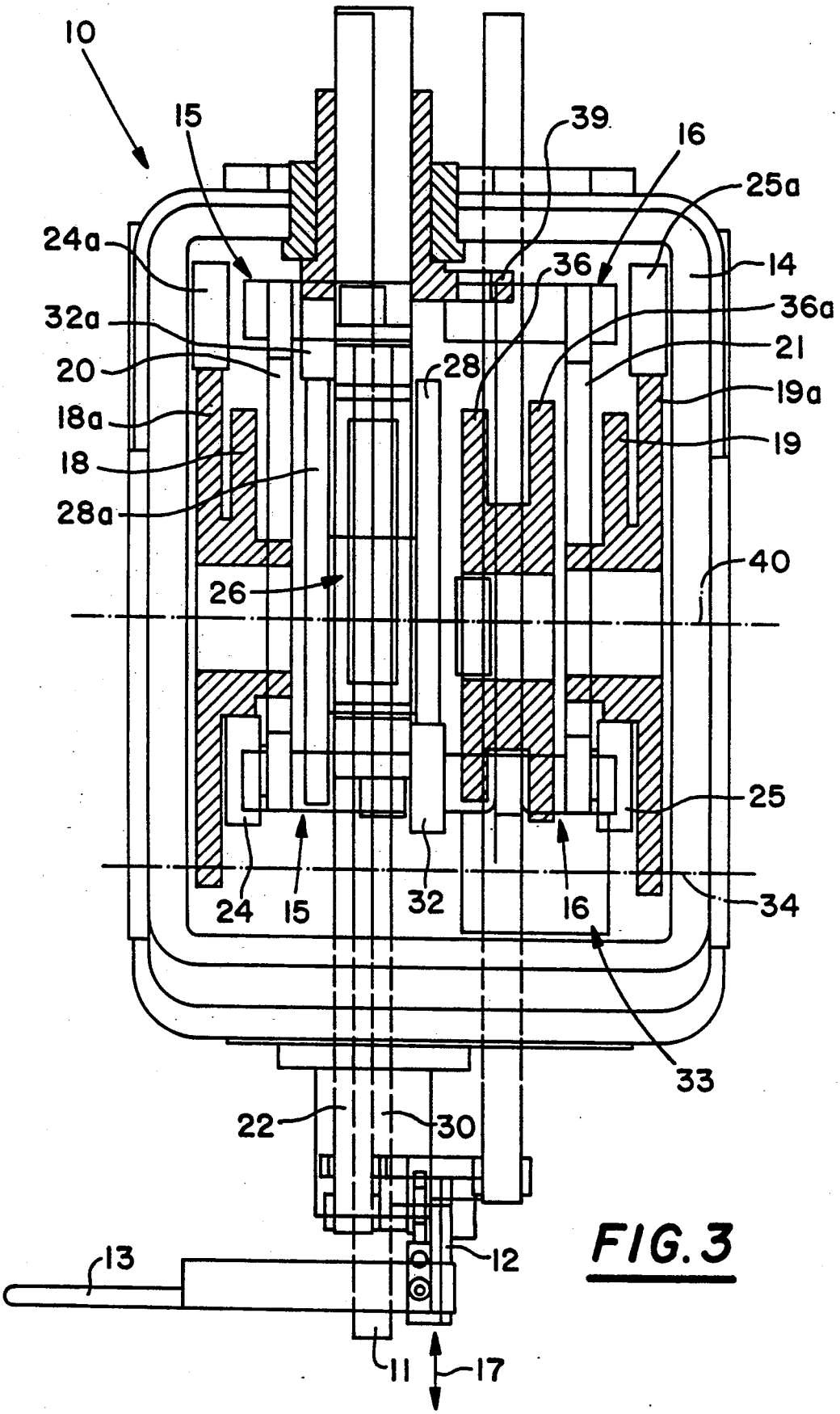

Referring initially to FIGS. 1-3 of the accompanying drawings, the selvedge-forming mechanism according to the present invention is generally indicated by the reference numeral 10, and is structurally formed by a gripper 11-scissors 12 group, a needle 13, and a plurality of kinematic drive means to drive them, contained inside a box or case 14.

Figure 4:
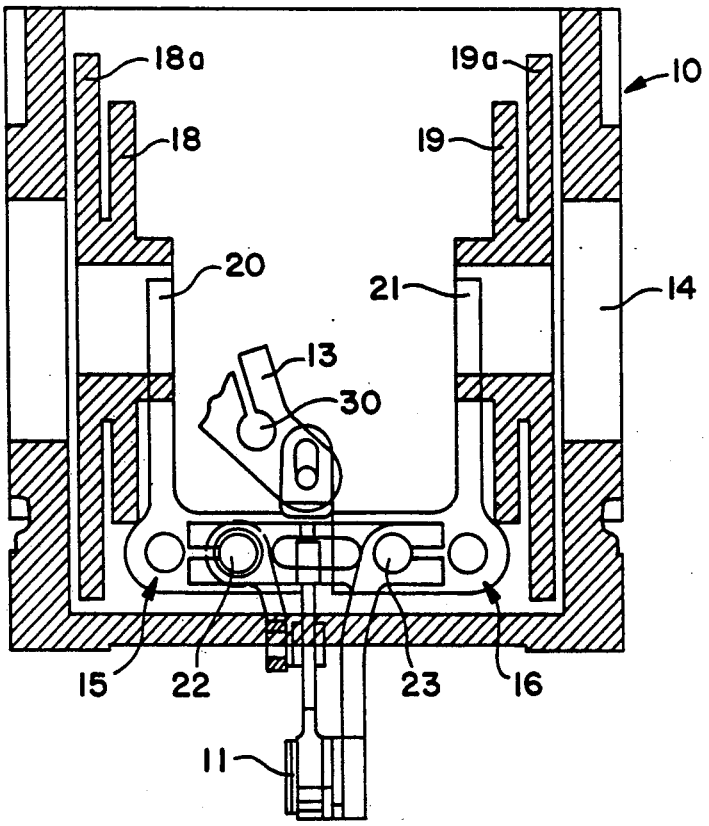
FIGS. 4, 5 and 6 show vertical transversal sectional, vertical longitudinal sectional and horizontal cross-sectional views respectively, illustrating only the gripper-scissors group of the selvedge-forming mechanism, and the relevant kinematic drive means which drive it, in their non-operative position (i.e., in their cycle-beginning position)
Figure 5:
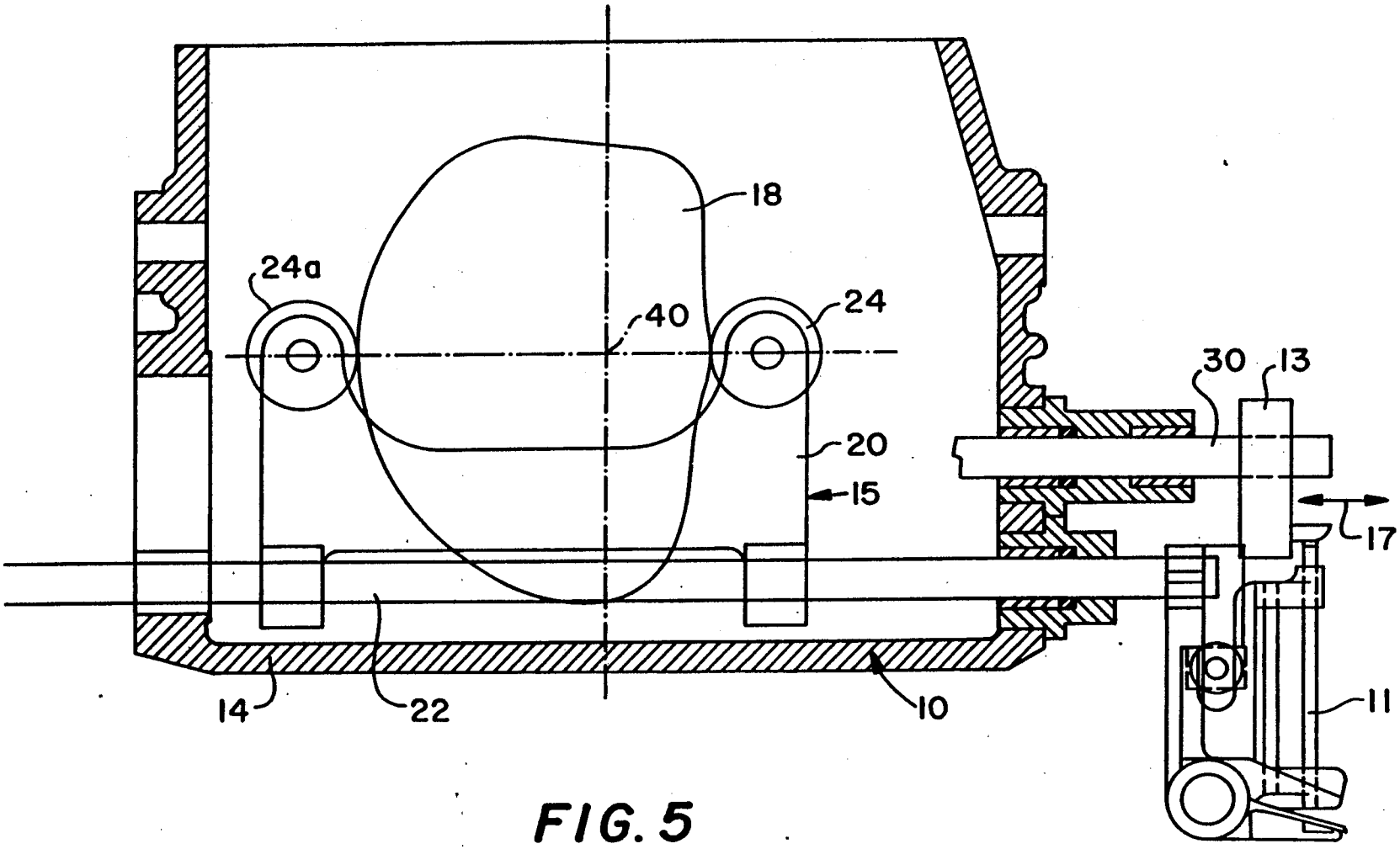
Figure 6:
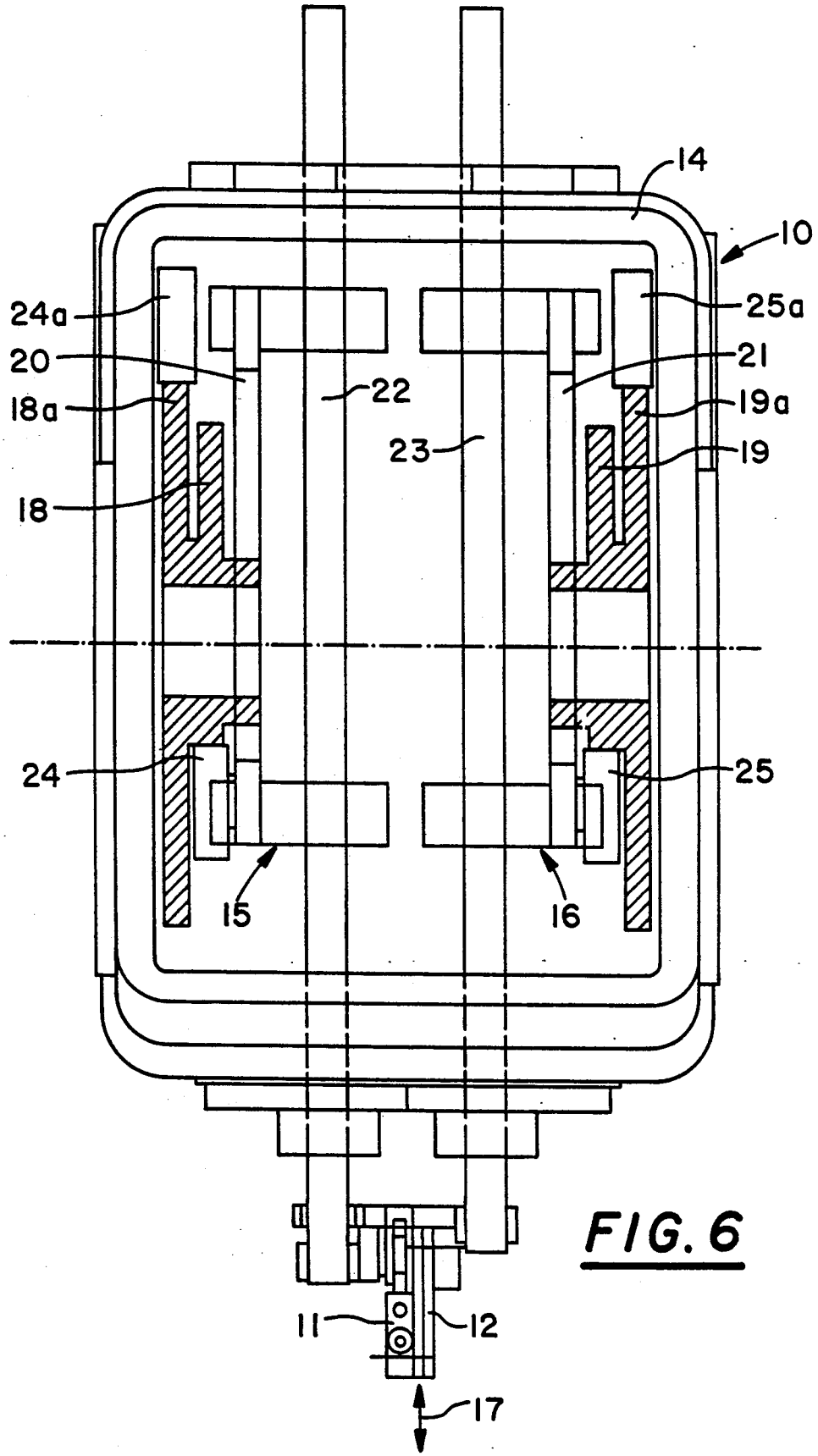

Referring to FIGS. 4-6 of the accompanying drawings, the pincers 11-scissors 12 group is installed on two side carriages 15, 16, which are driven to reciprocate in the directions of the arrow 17, by means of respective cams 18, 19, which typically directly act on the same carriages 15, 16, with only the interposition of a cam follower, as is explained hereinbelow.

More precisely (with regard to FIGS. 4-6), the carriages 15, 16 comprise a chassis 20, 21, having substantially an "L"-shaped contour, fastened to guide rods 22, 23 slidingly installed on the case 14, as is clearly shown in the drawings.

At the front ends of the guide rods 22, 23, the gripper 11-scissors 12 group is constrained.

The cams 18, 19 act on respective rollers (cam followers) 24, 25 journalled for rotation on the respective chassis 20, 21 of the carriages 15, 16.

To secure the motion to take place at the high speeds required, with the cams 18, 19, conjugate cams 18*a*, 19*a* (integral with the cams 18, 19) cooperate, which act on respective rollers 24*d*, 25*a* hinged onto the chassis 20, 21.

Figure 7:
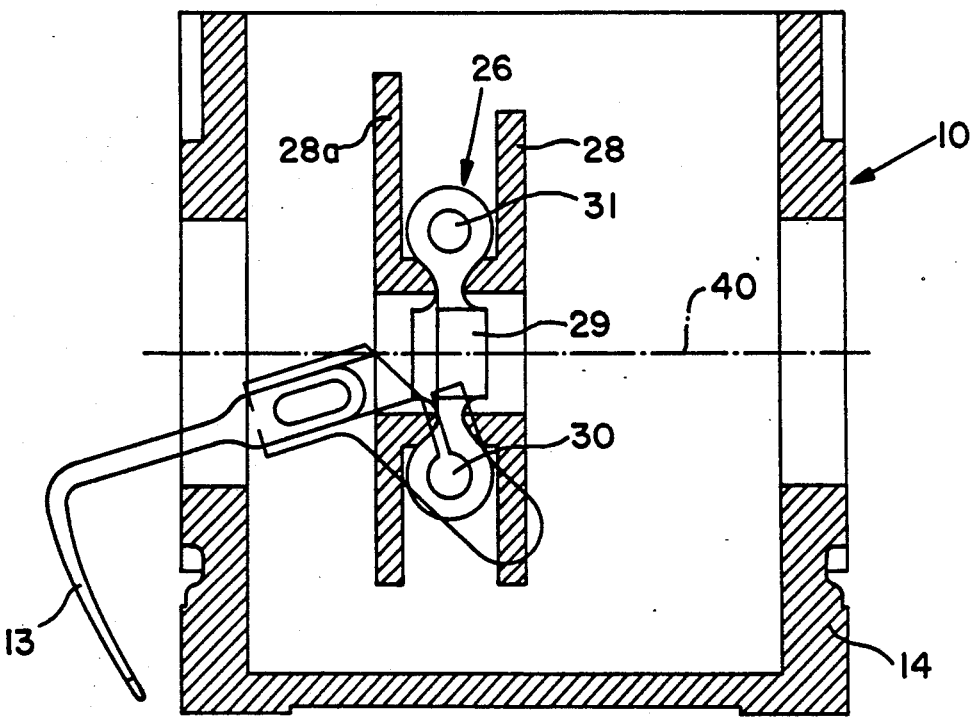
FIGS. 7, 8 and 9 show vertical transversal sectional, vertical longitudinal sectional and horizontal cross-sectional views respectively, illustrating only the needle of the selvedge-forming mechanism, and the relevant kinematic drive means which drive the coming-out thereof, in their non-operative position (i.e., in their cycle-beginning position)
Figure 8:
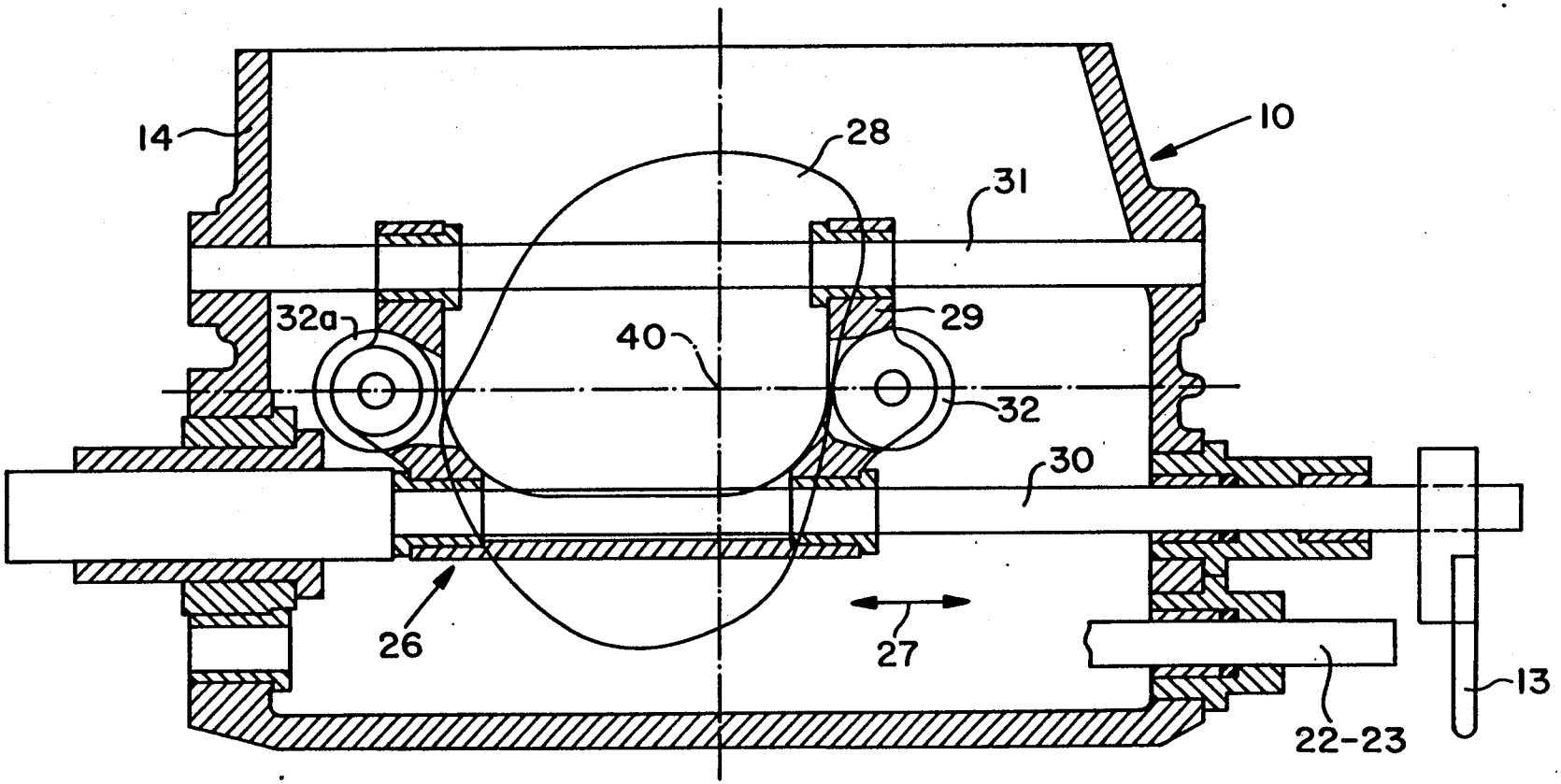
Figure 9:
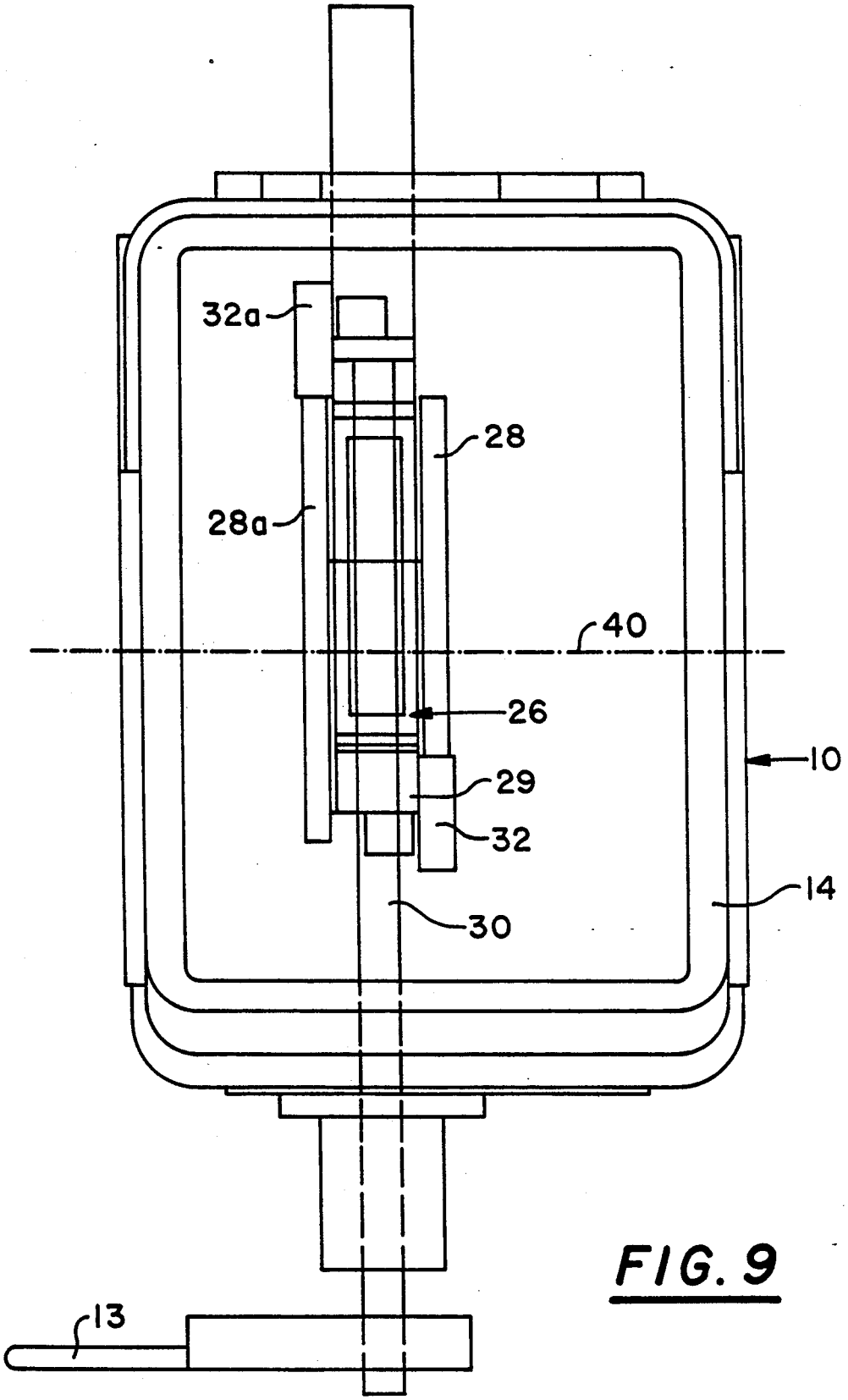

Referring to FIGS. 7-9 of the accompanying drawings, the needle 13 is installed on a central carriage 26, which is driven to reciprocate in the directions of the arrow 27, by means of a cam 28 directly acting on the same carriage 26, with only the interposition of a cam follower, as is explained hereinbelow.

More precisely, the carriage 26 comprises a chassis 29, substantially cradle-shaped, constrained to a bottom guide/drive rod 30, which is installed on the case 14, with possibility of translation and rotation, as is clearly illustrated in the drawings, and as is explained in greater detail hereinbelow.

The needle 13 is fastened onto the front end of the rod 30.

With the lower rod 30, an upper rod 31—fastened to the case 14—cooperates. The carriage 26 reciprocates on the rod 31.

The cam 28 acts on a roller 32 journalled for rotation on the chassis 29 of the carriage 26.

Also in this case, to secure the motion to take place at the required high speeds, with the cam 28, a conjugated cam 28*a* (integral with the cam 28) cooperates, which acts on a roller 32*a* journalled for rotation on the chassis 29 of the carriage 26.

Figure 10:
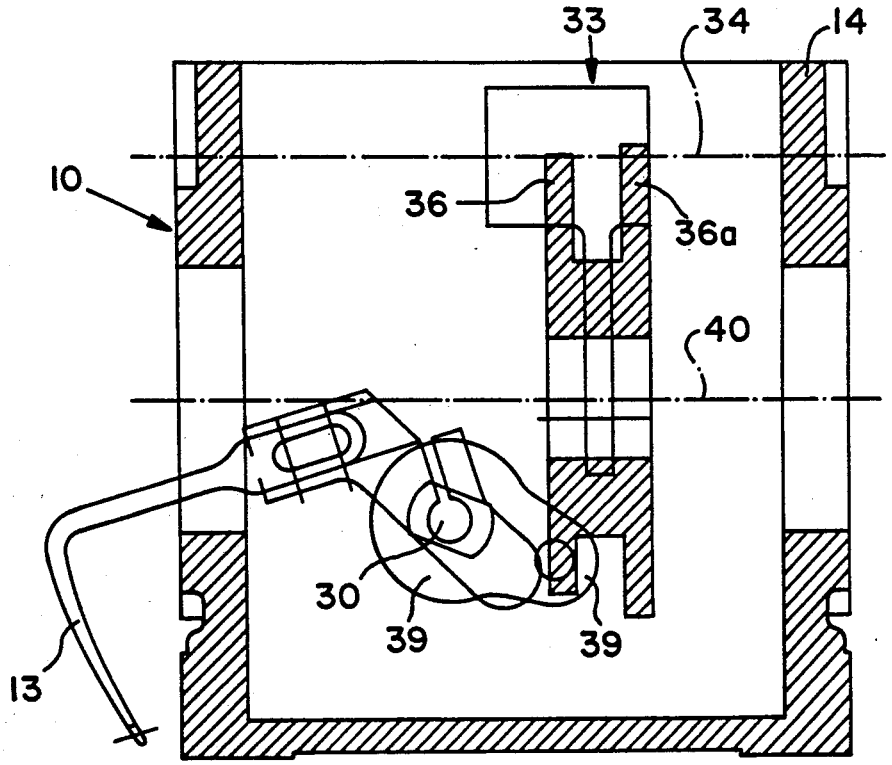
FIGS. 10, 11 and 12 show vertical transversal sectional, vertical longitudinal sectional and horizontal cross-sectional views respectively, illustrating only the needle of the selvedge-forming mechanism, and the relevant kinematic drive means which drive the rotation thereof, in their non-operative position (i.e., in their cycle-beginning position)
Figure 11:
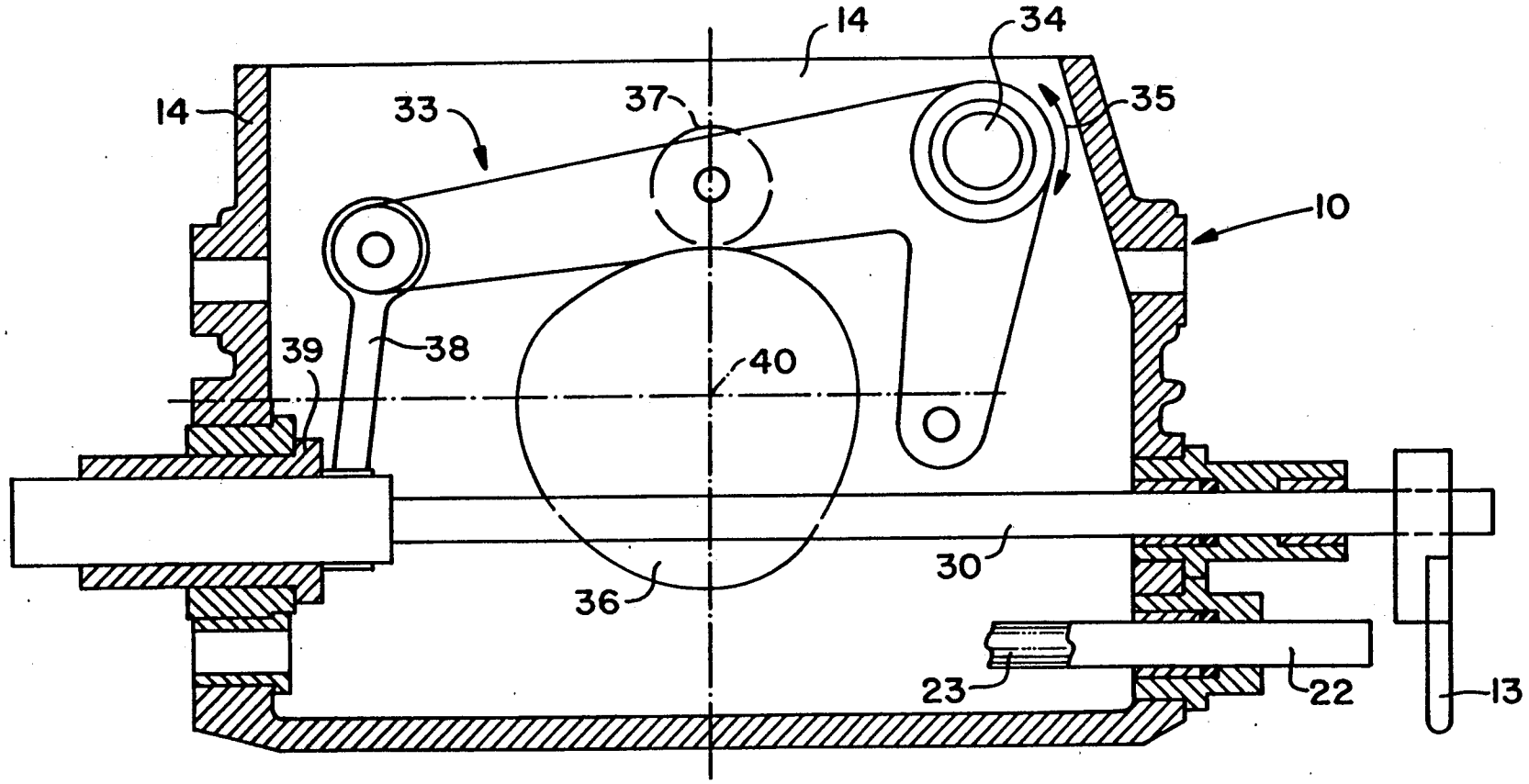
Figure 12:
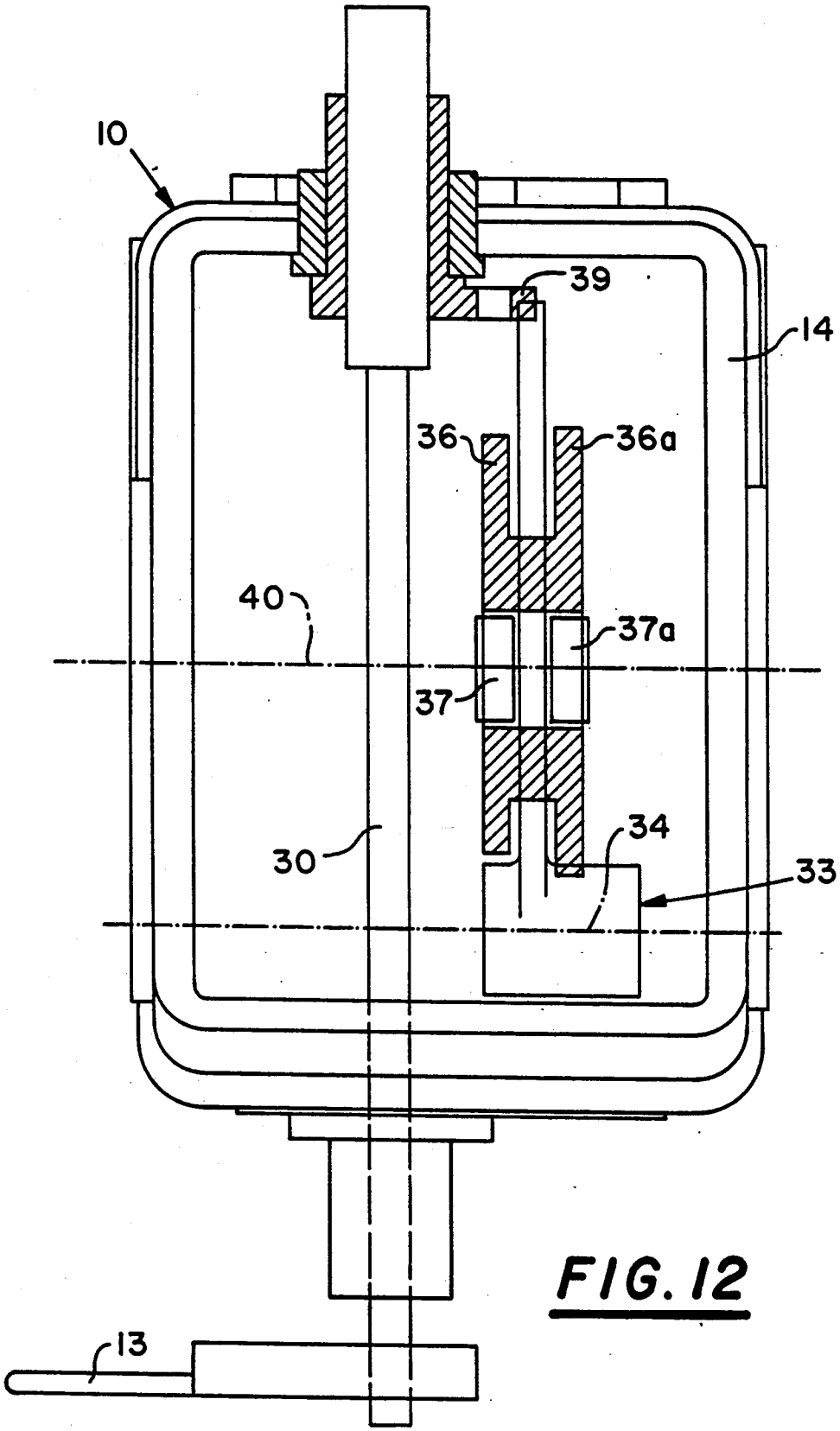

Referring to FIGS. 10-12 of the accompanying drawings, the rotation of the needle 13 is driven by a bell crank 33 journalled for rotation at 34 on the case 14.

The swinging of the bell crank 33 in the directions of the arrow 35 is driven by a cam 36 acting on a roller 37 journalled for rotation on the same bell crank 33. A conjugated cam 36*a* (integral with the cam 36) acts on a roller 37*a*, also journalled for rotation on the bell crank 33.

The bell crank 33 is operatively linked with the lower rod 30, in order to drive the lower rod to rotate, by means of a shackle 38, which is journalled for rotation on an end of the lever 33, and on the opposite end of a radial arm 39 constrained to the rod 30 so as to be capable of rotating, but not of translating.

The operation of the selvedge-forming mechanism according to the present invention will be clear from the description provided above, as disclosed by referring to the drawings and, briefly, is as follows:

The selvedge-forming mechanism receives the motion in a per se known way from the main shaft of the loom on which the mechanism is installed. In fact, the shaft of the loom drives, through a suitable kinematic motion transmission link, the shaft schematically shown in 40, on which all the driving cams which actuate the selvedge-forming mechanism are installed.

FIGS. 1-12 show the selvedge-forming mechanism in its resting position, at cycle beginning.

Figure 13:
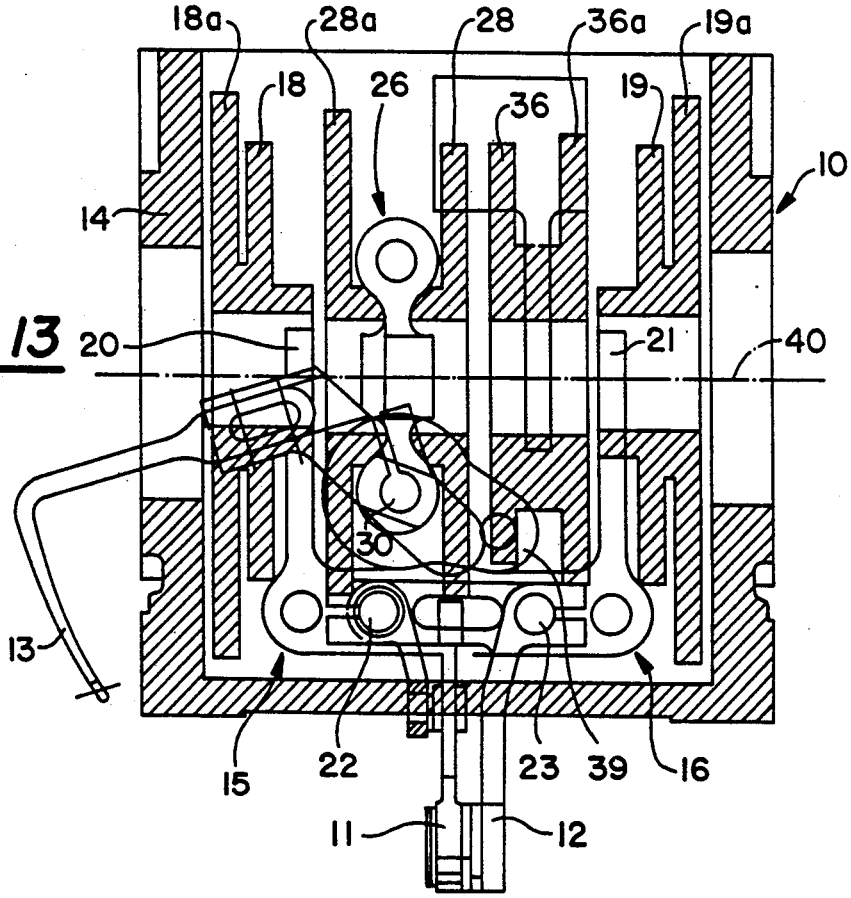
FIGS. 13, 14 and 15 show vertical transversal sectional, vertical longitudinal sectional and horizontal cross-sectional views respectively, illustrating the whole selvedge-forming mechanism, with the gripper-scissors group thereof being in a transient step of their coming out, and the needle thereof being in a transient step of coming out and of (zero) rotation of the same needle.
Figure 14:
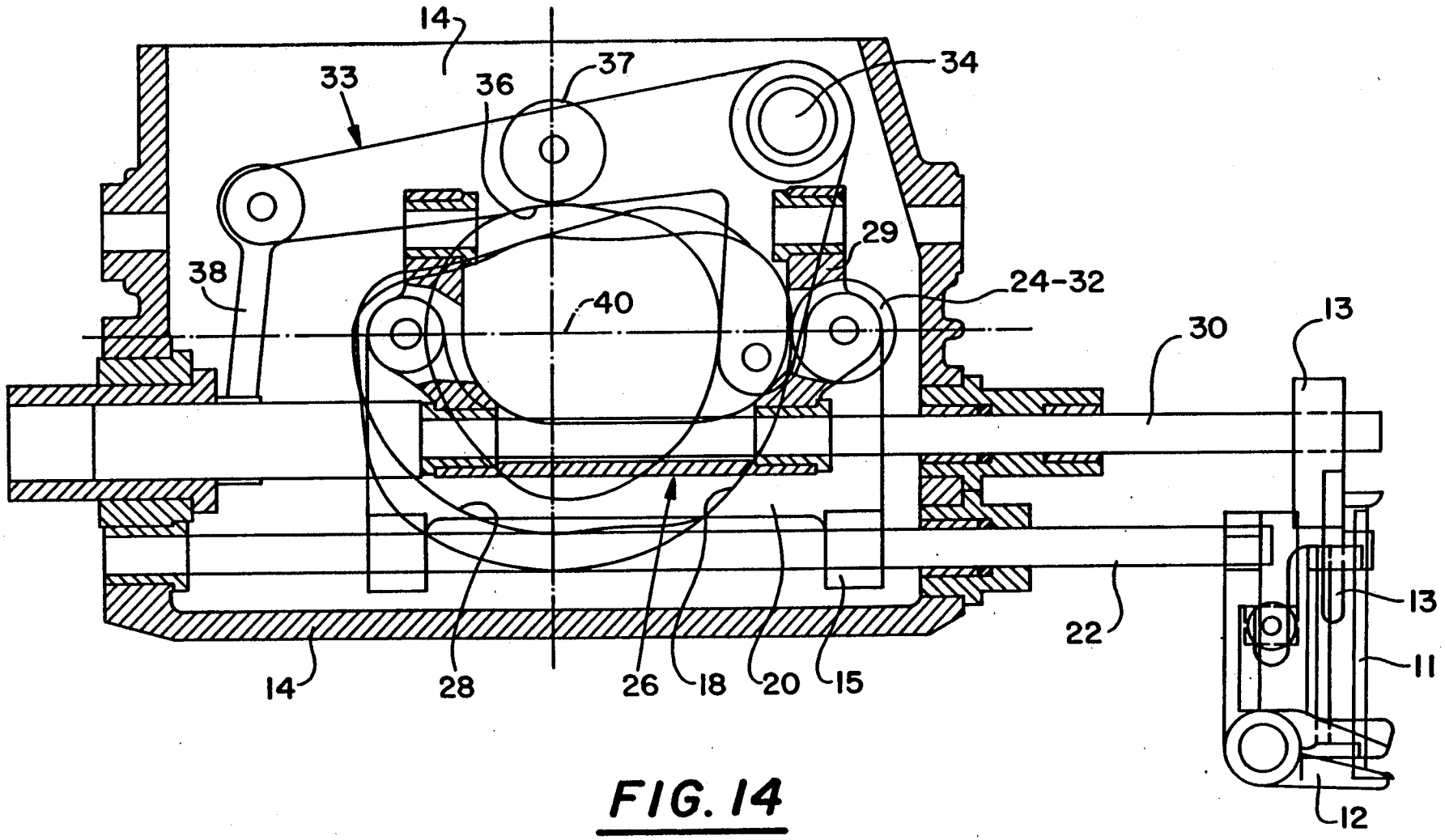
Figure 15:
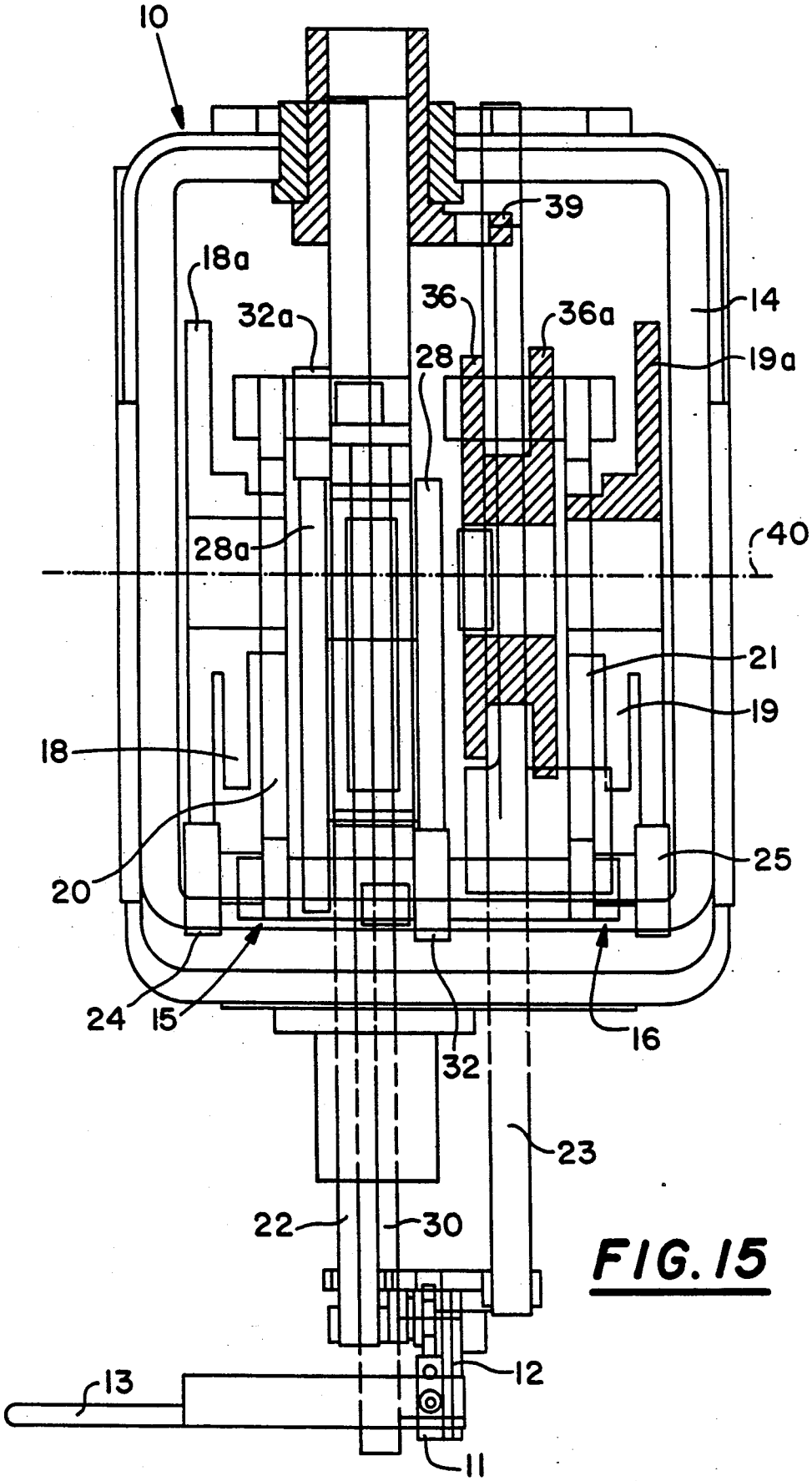

The rotation of the driving cams 18, 19 and 28 causes the respective carriages 15, 16 and 26 to translate forwards, and to cause the gripper 11-scissors 12 group and the needle 23 to come out, to the position depicted in FIGS. 13, 14 and 15. During this transient step of coming out, the needle 13 does not rotate.

Figure 16:
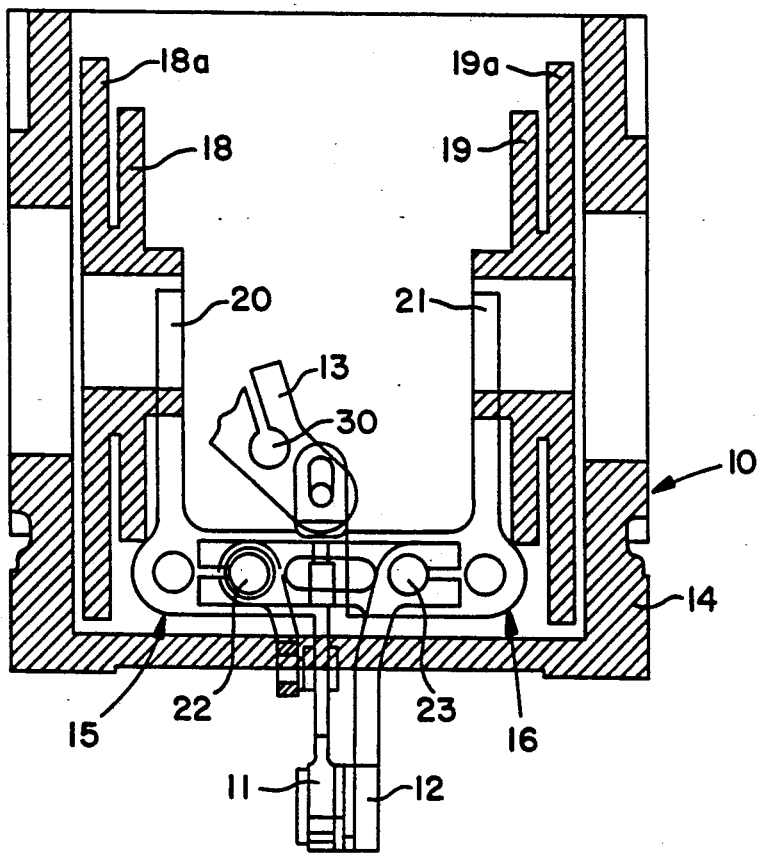
FIGS. 16, 17 and 18 show vertical transversal sectional, vertical longitudinal sectional and horizontal cross-sectional views respectively, illustrating only the gripper-scissors group of the selvedge-forming mechanism, and the relevant kinematic drive means which drive it, during the transient step of its coming out as shown in FIGS. 13, 14 and 15.
Figure 17:
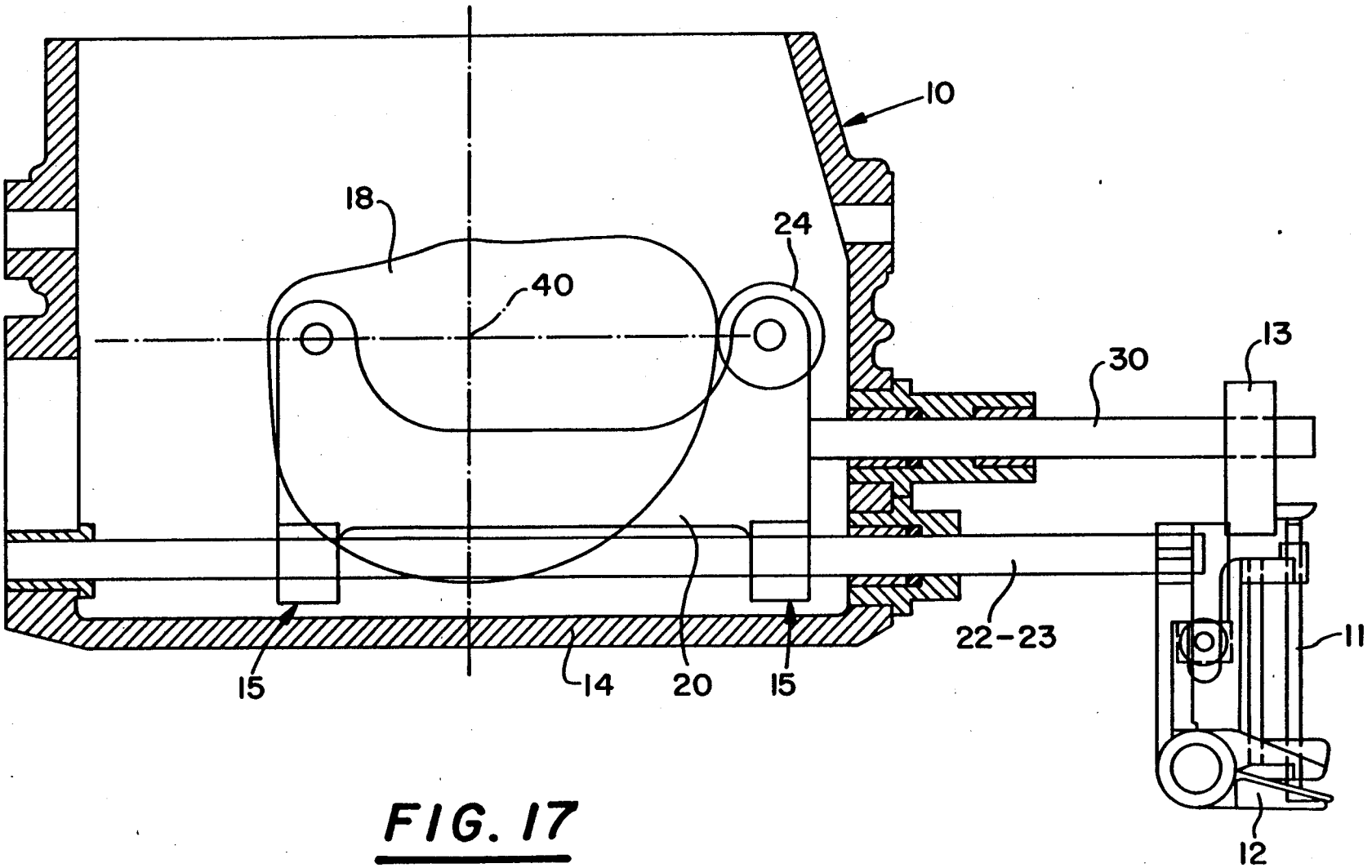
Figure 18:
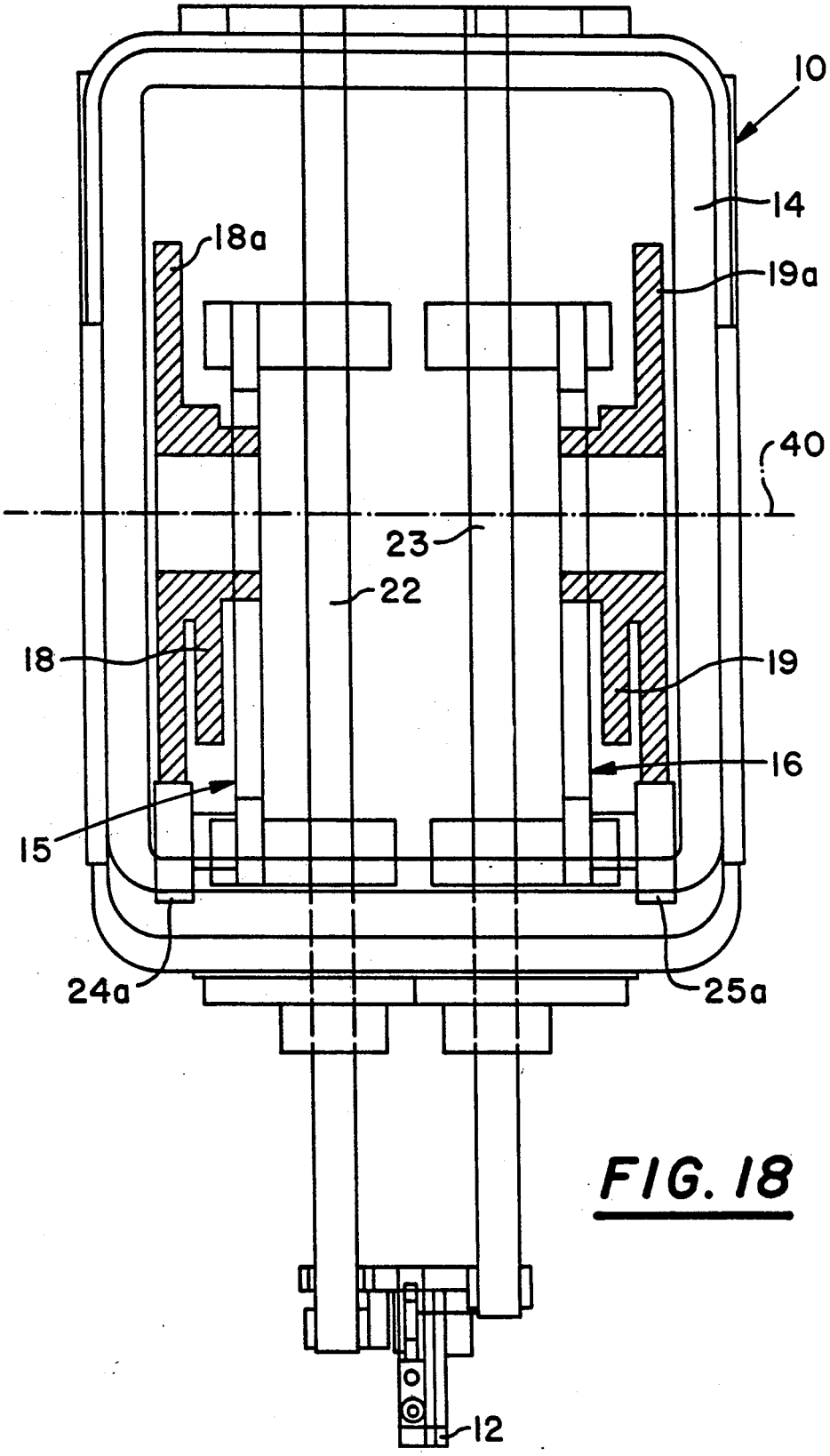

FIGS. 16-18 show in detail only the movement of gripper 11-scissors 12 group coming out.

Figure 19:
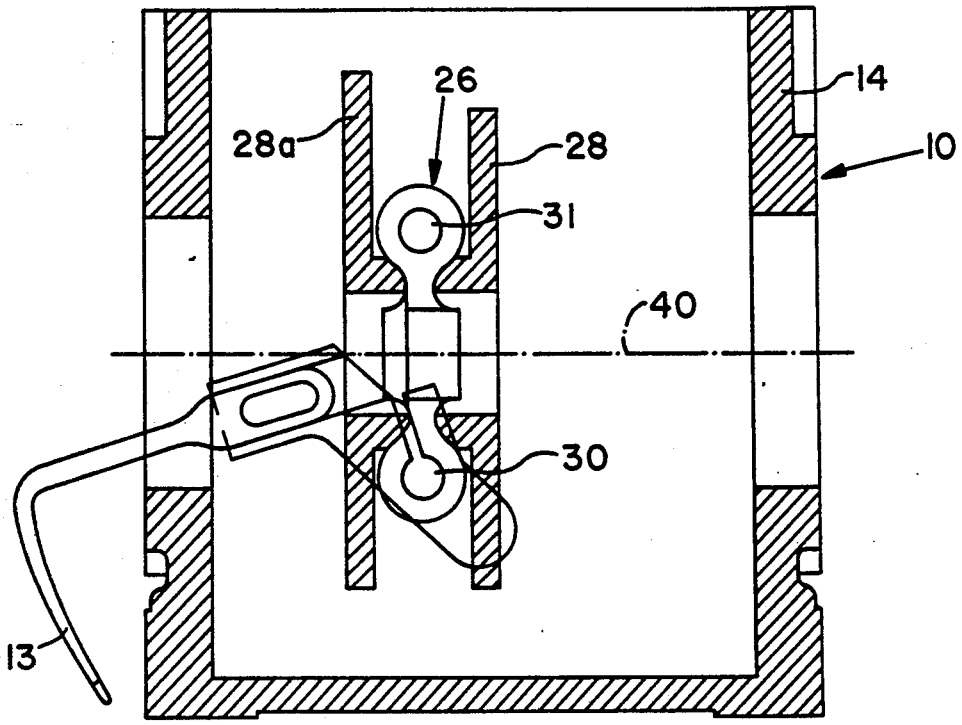
FIGS. 19, 20 and 21 show vertical transversal sectional, vertical longitudinal sectional and horizontal cross-sectional views respectively, illustrating only the needle of the selvedge-forming mechanism, and the relevant kinematic drive means which drive it, during the transient step of needle coming-out as shown in FIGS. 13, 14 and 15.
Figure 20:
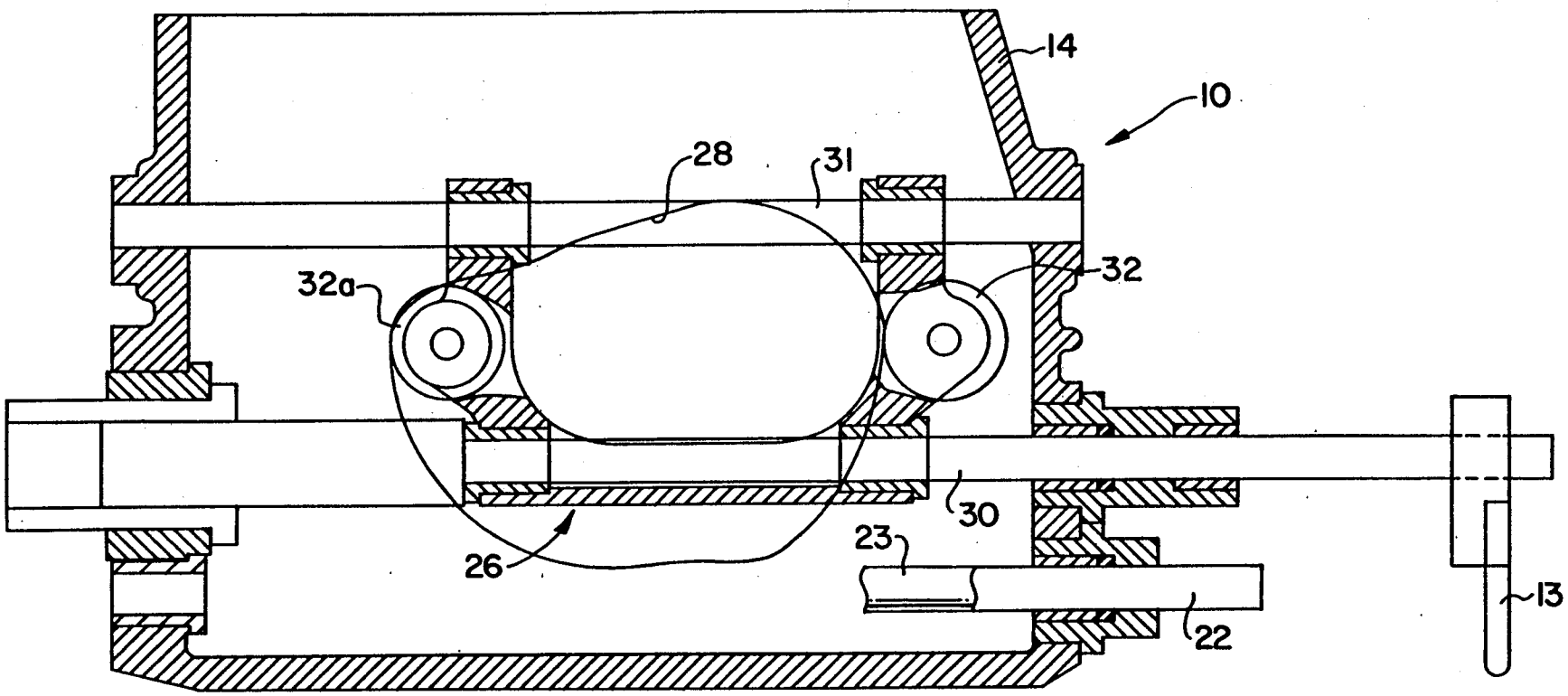
Figure 21:
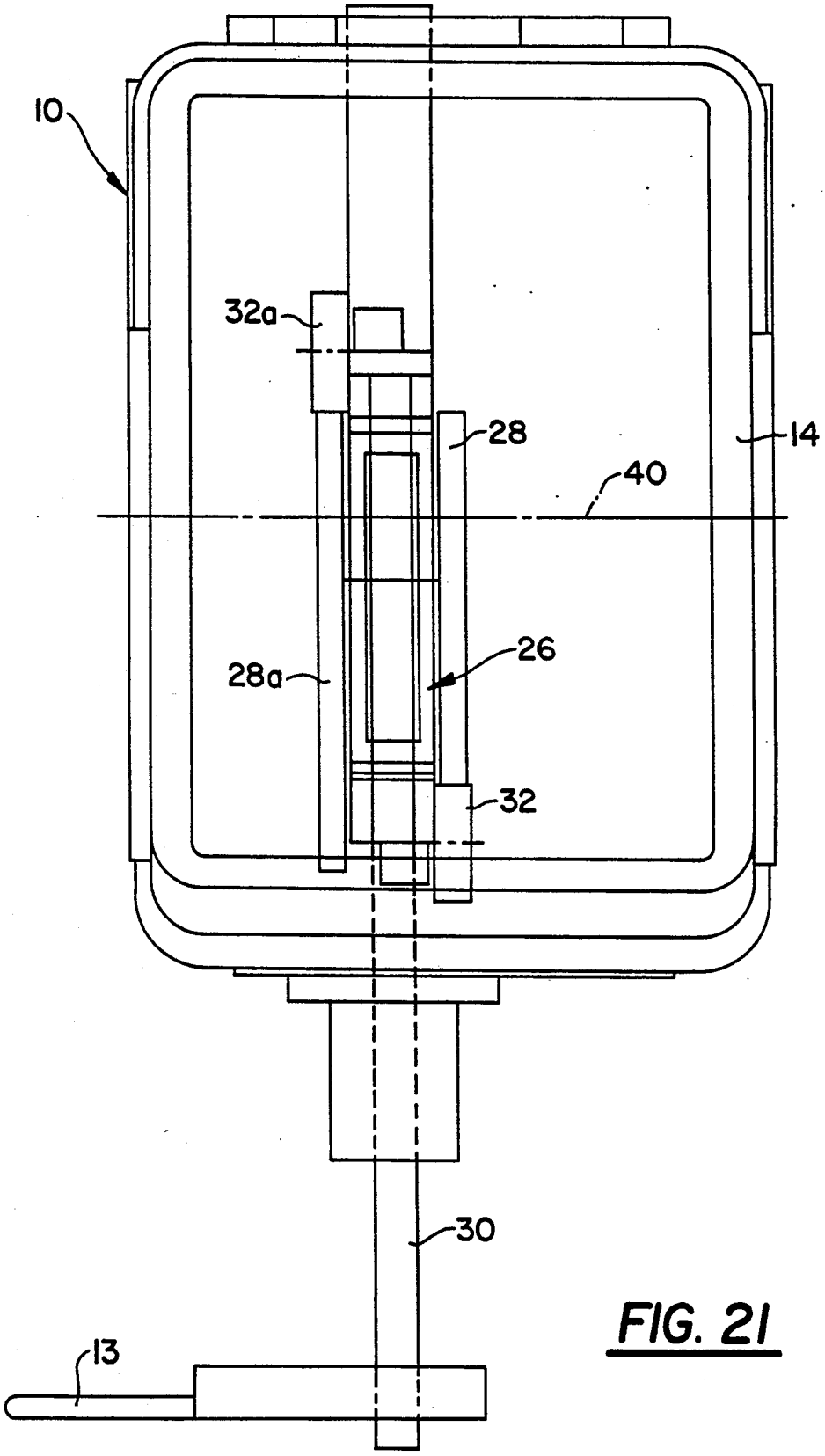

FIGS. 19-21 show in detail only the movement of needle 13 coming out.

Figure 22:
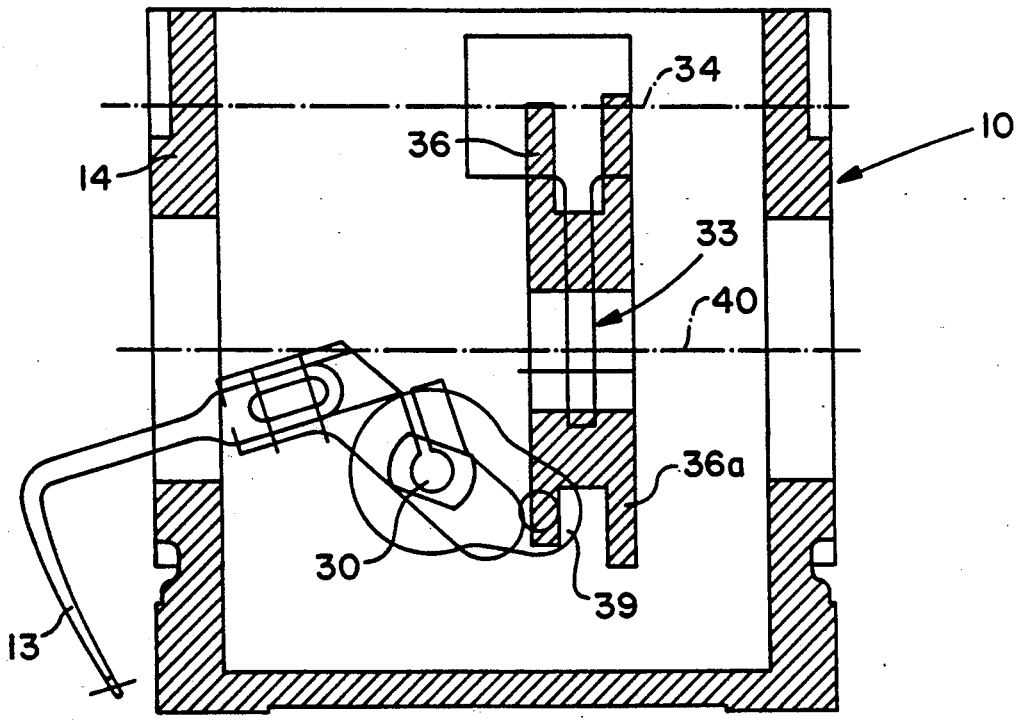
FIGS. 22, 23 and 24 show vertical transversal sectional, vertical longitudinal sectional and horizontal cross-sectional views respectively, illustrating only the needle of the selvedge-forming mechanism, and the relevant kinematic drive means which drive it, during the translent step of its rotation (zero) as shown in FIGS. 13, 14 and 15.
Figure 23:
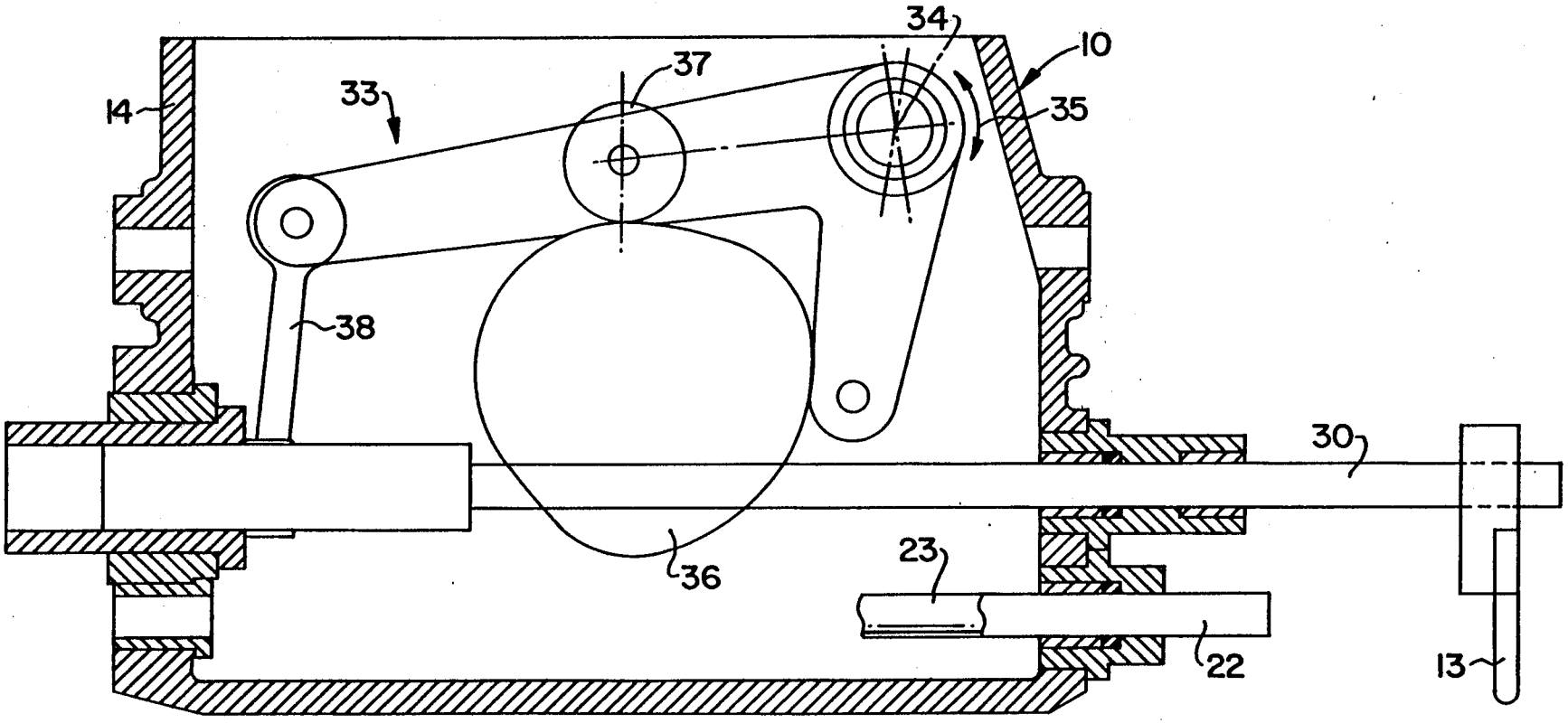
Figure 24:
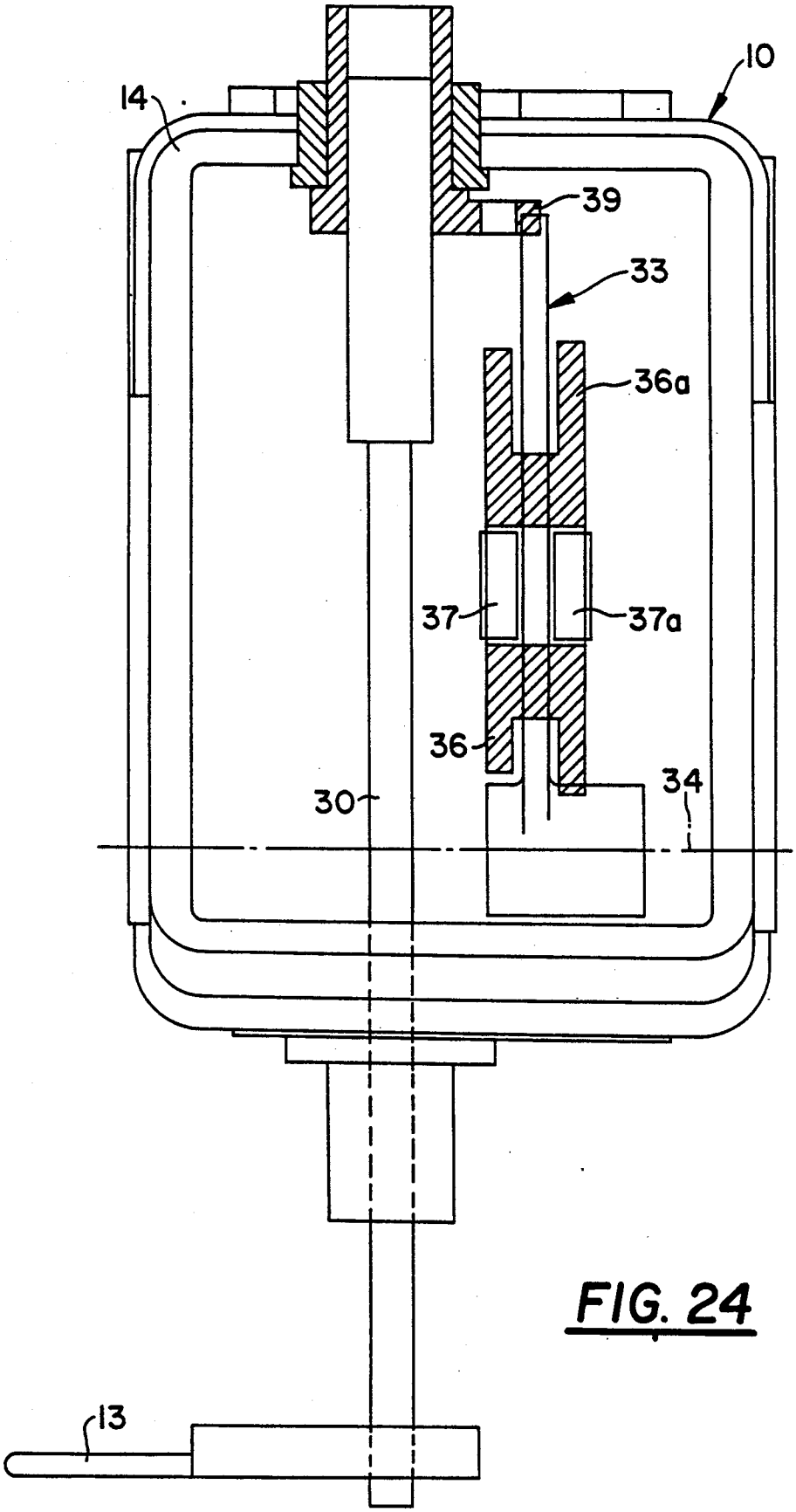

FIGS. 22-24 show in detail the zero rotation of the needle 13.

Figure 25:
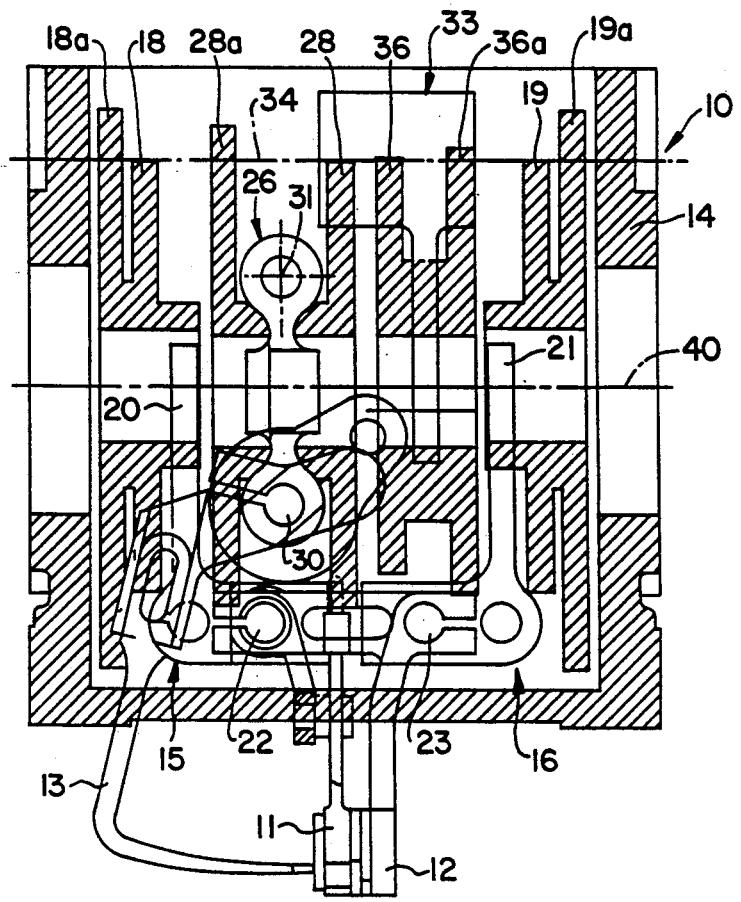
FIGS. 25, 26 and 27 show vertical transversal sectional, vertical longitudinal sectional and horizontal cross-sectional views respectively, illustrating the whole selvedge-forming mechanism with its gripper being in its end come-out and lowered position, and its needle being in its come-out and rotated position.
Figure 26:
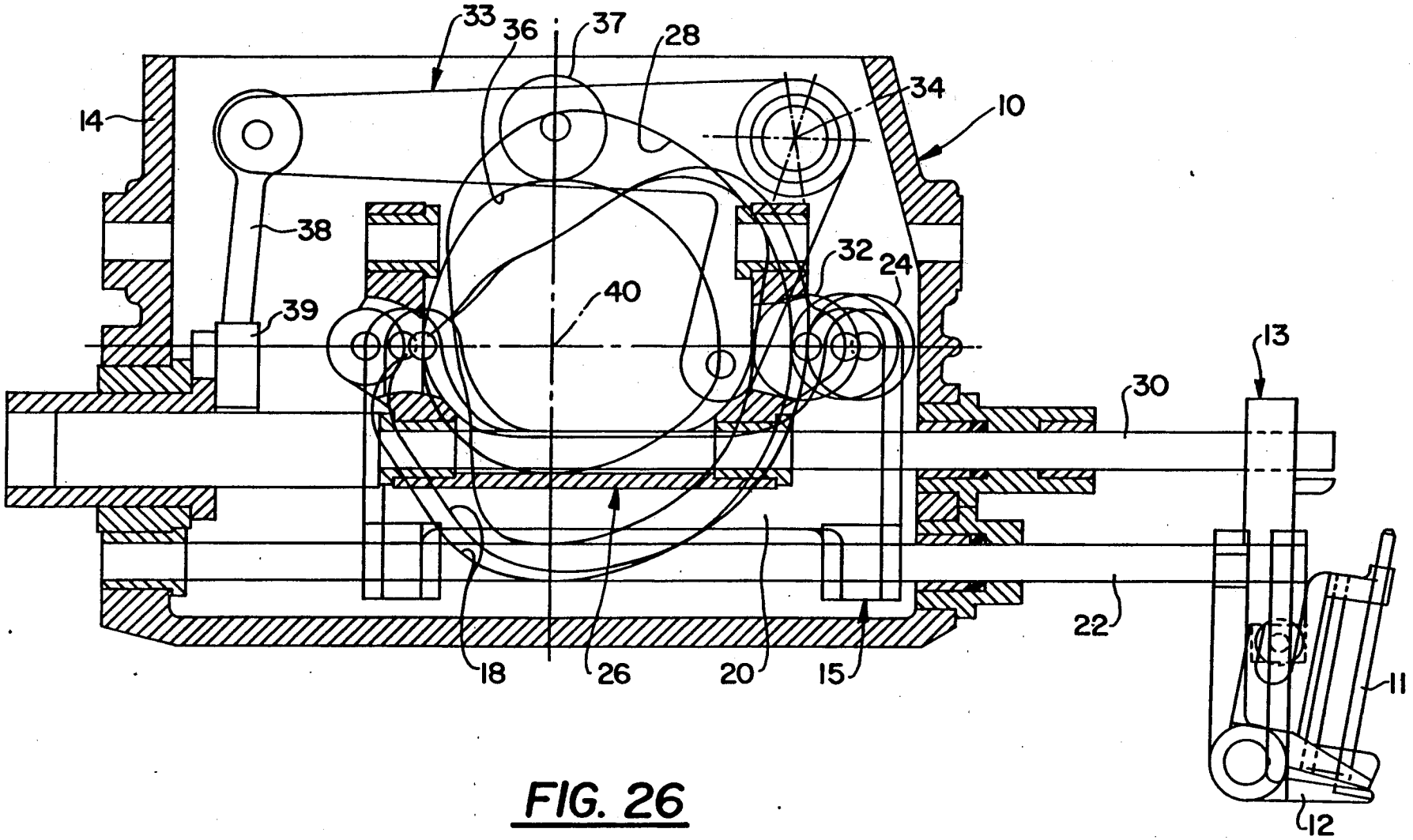
Figure 27:
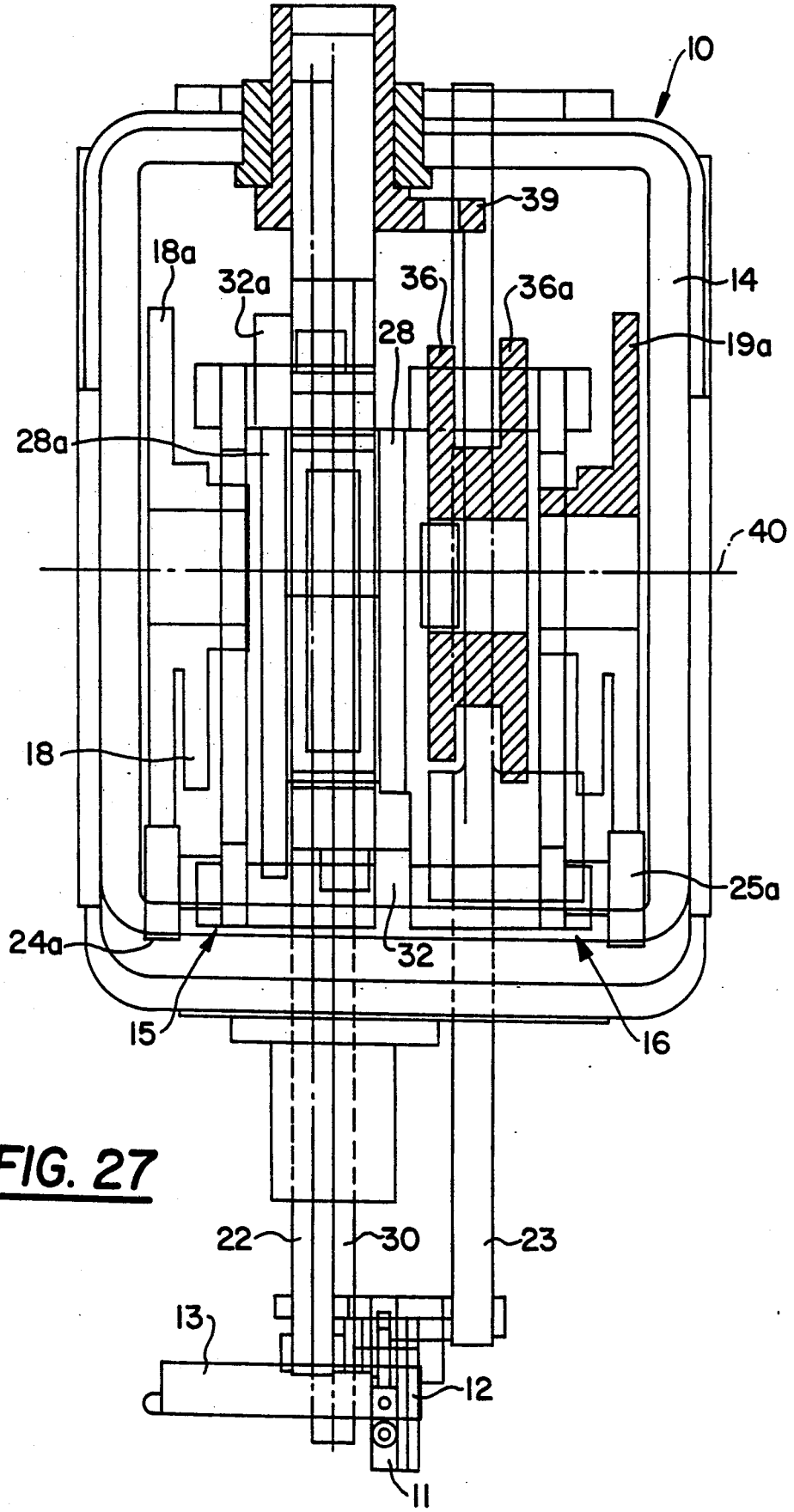

The gripper 11-scissors 12 group and the needle 13 complete their coming-out movement in their position shown in FIGS. 25-27, and in this position the gripper 11 has also moved downwards to cause the pick to be cut, and the needle 13 has rotated in order to capture the tail of the cut pick, and to cause it to enter back, in a bent condition (as shown), the shed, which closes onto it.

Figure 28:
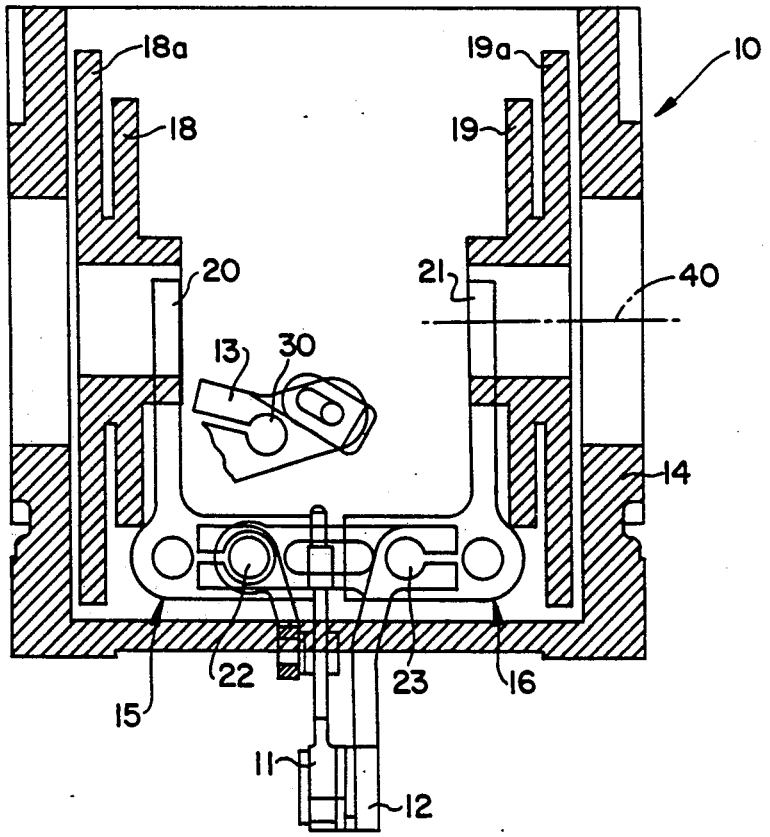
FIGS. 28, 29 and 30 show vertical transversal sectional, vertical longitudinal sectional and horizontal cross-sectional views respectively, illustrating only the gripper-scissors group of the selvedge-forming mechanism and the kinematic drive means which control it, in its end come-out and lowered position in order to perform the cutting of the weft by the scissors, and to enable the needle to grip the cut pick tail.
Figure 29:
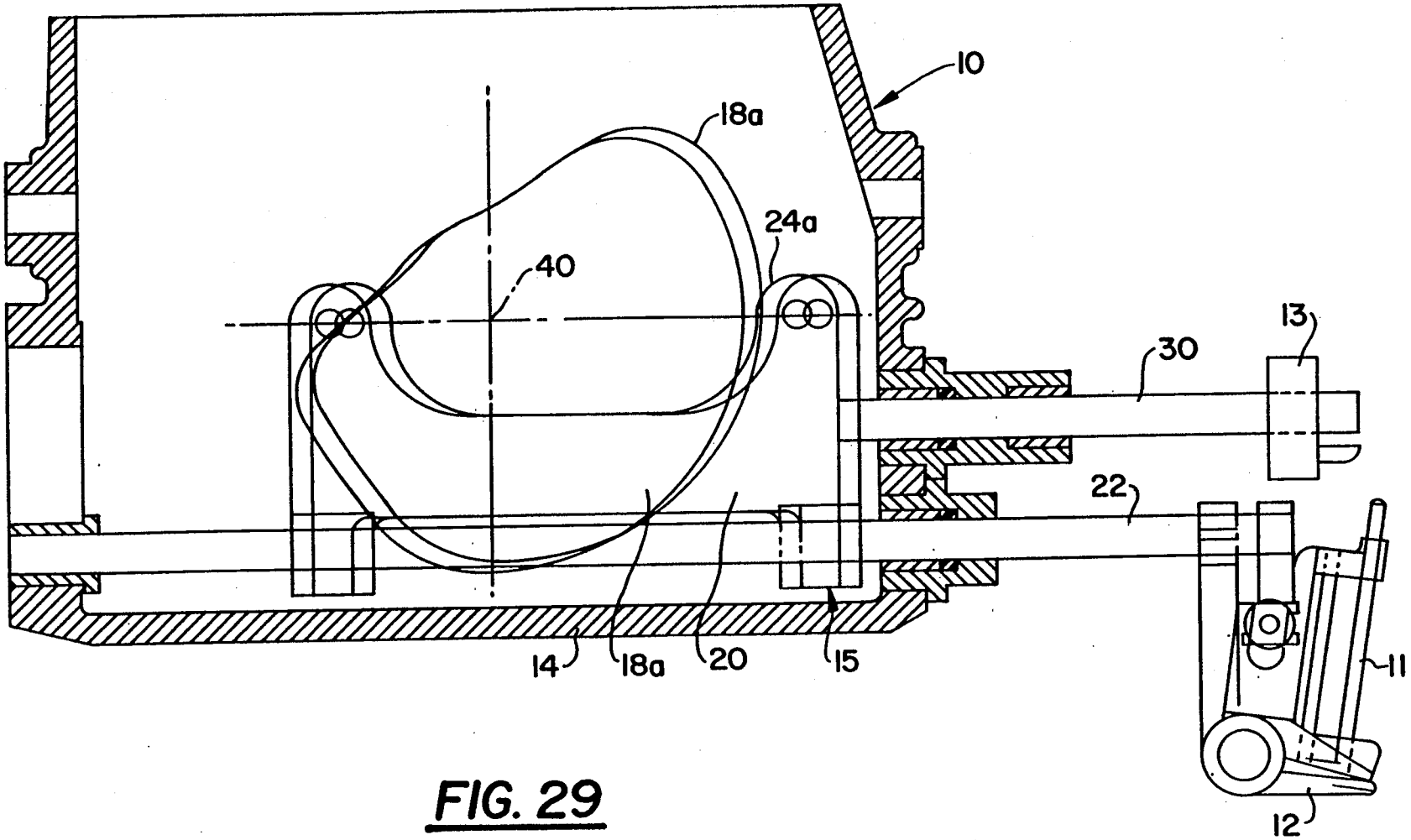
Figure 30:
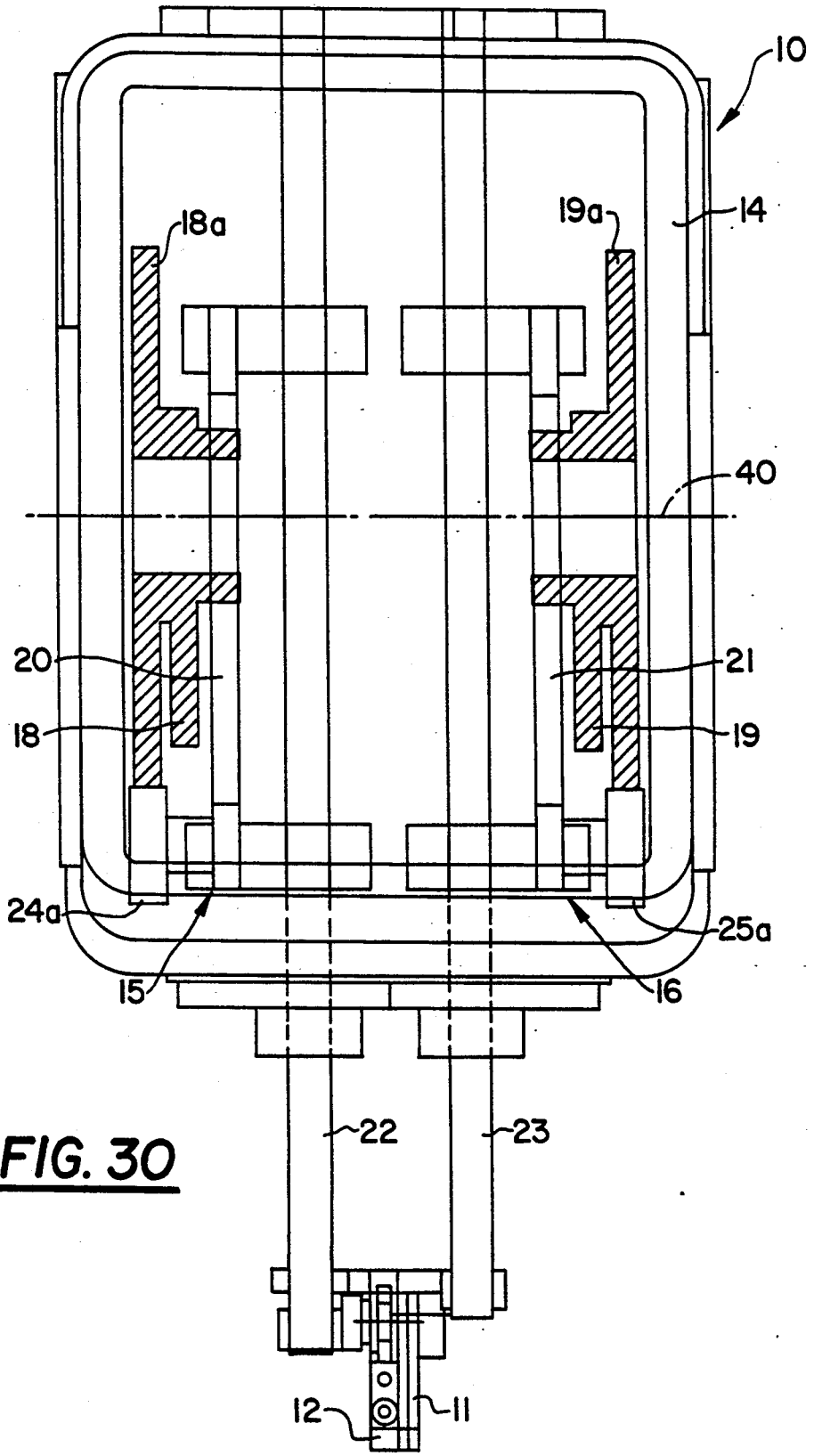

FIGS. 28-30 show in detail the end position of only the gripper 11-scissors 12 group, in its come-out and lowered position.

Figure 31:
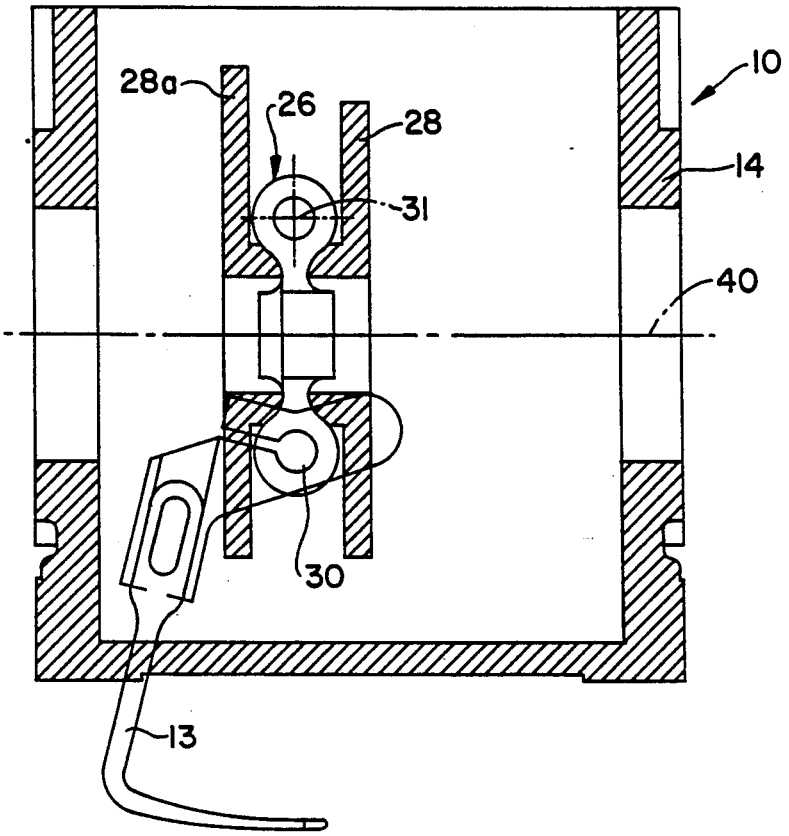
FIGS. 31, 32 and 33 show vertical transversal sectional, vertical longitudinal sectional and horizontal cross-sectional views respectively, illustrating only the needle of the selvedge-forming mechanism, and the relevant kinematic drive means which drive it to come out, in their positions shown in FIGS. 25, 26 and 27.
Figure 32:
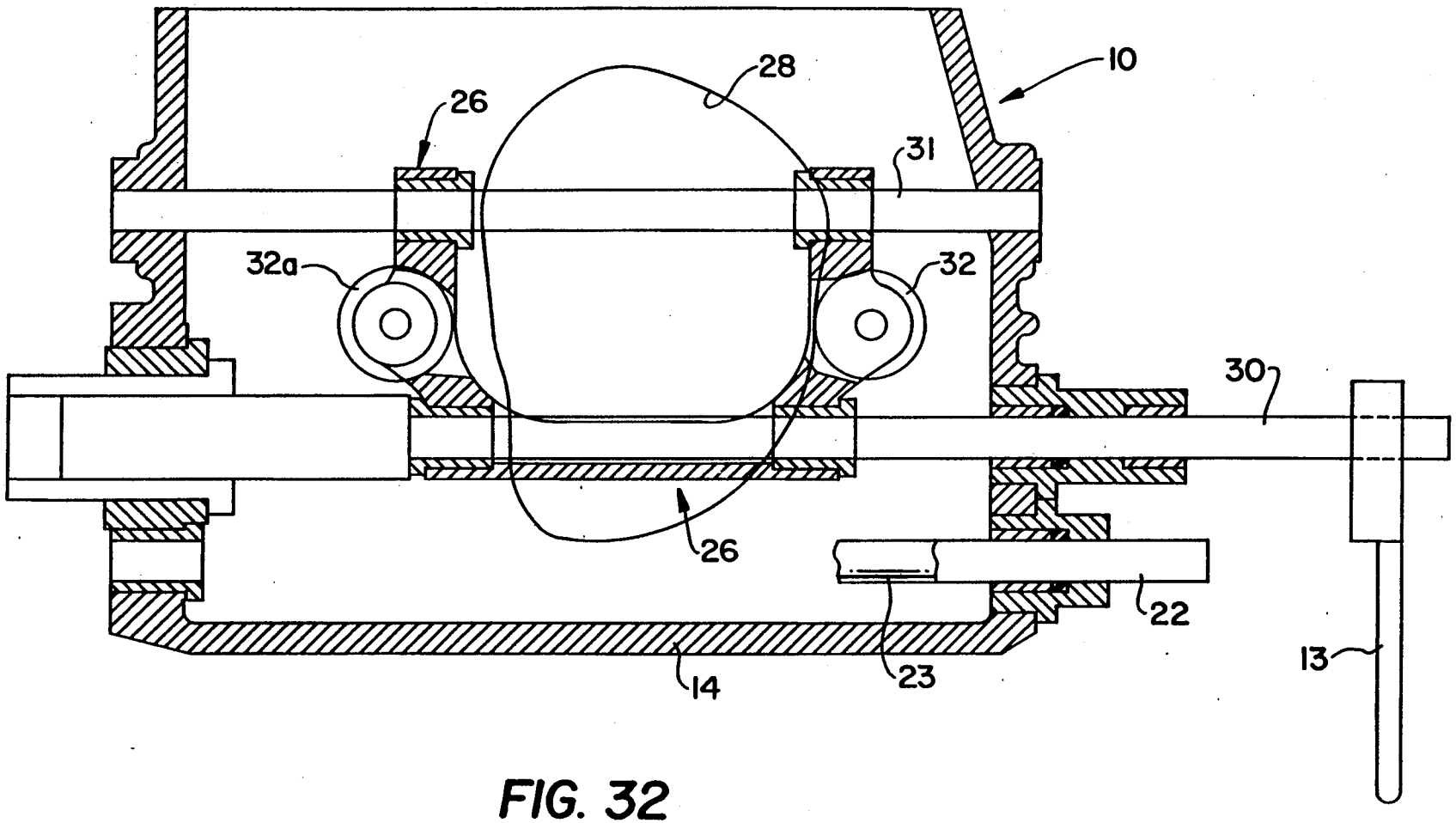
Figure 33:
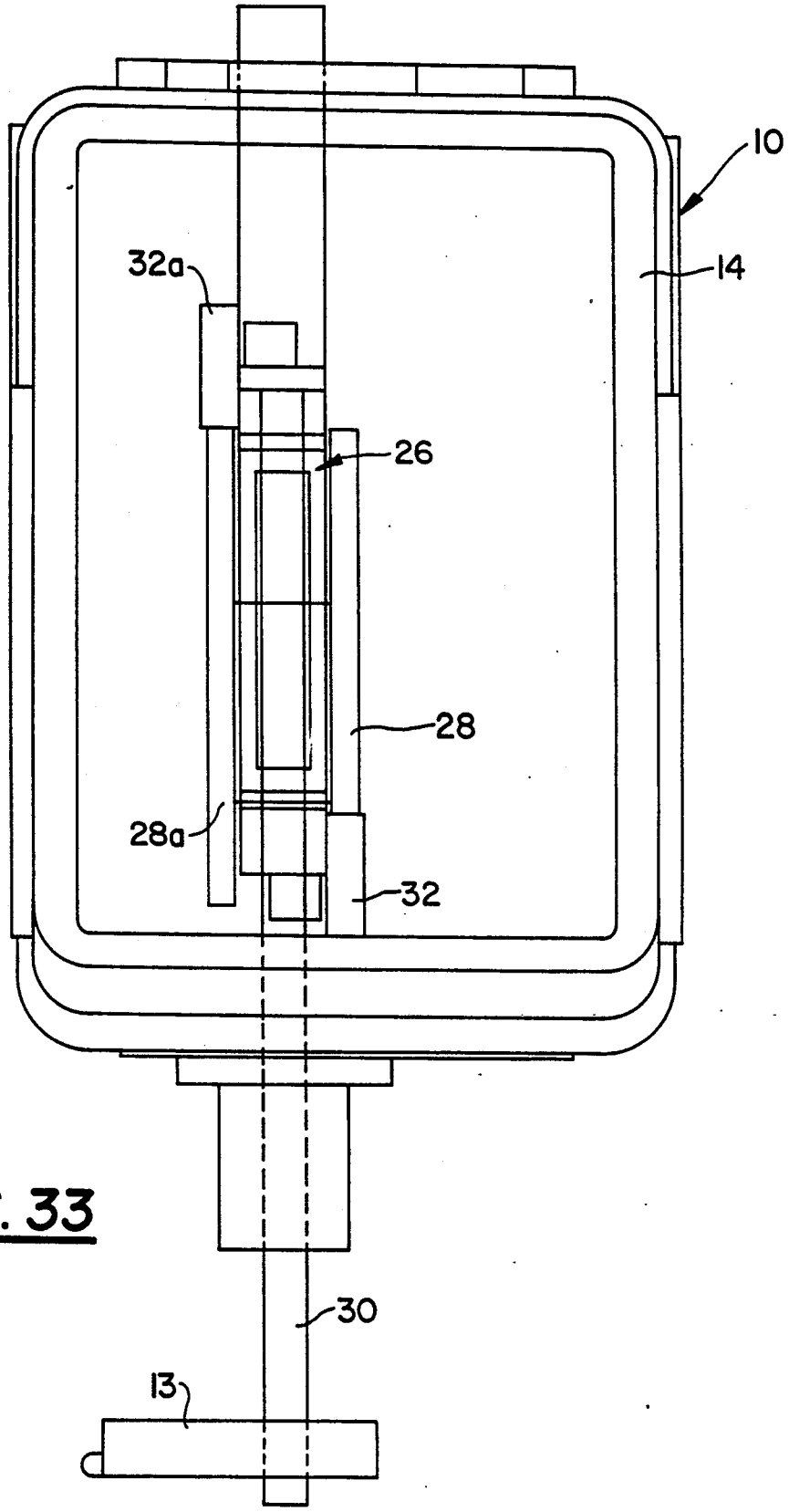

FIGS. 31-33 show in detail the end position reached by the come-out needle 13.

Figure 34:
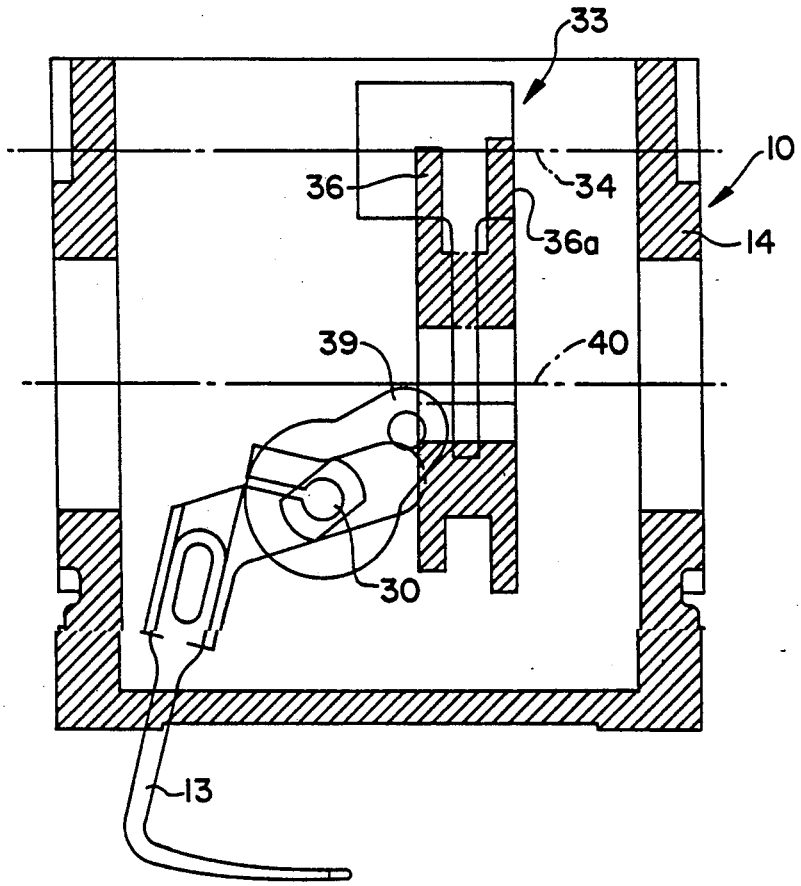
FIGS. 34, 35 and 36 show vertical transversal sectional, vertical longitudinal sectional and horizontal cross-sectional views respectively, illustrating only the needle of the selvedge-forming mechanism, and the relevant kinematic drive means which drive it to rotate, in their positions shown in FIGS. 25, 26 and 27.
Figure 35:
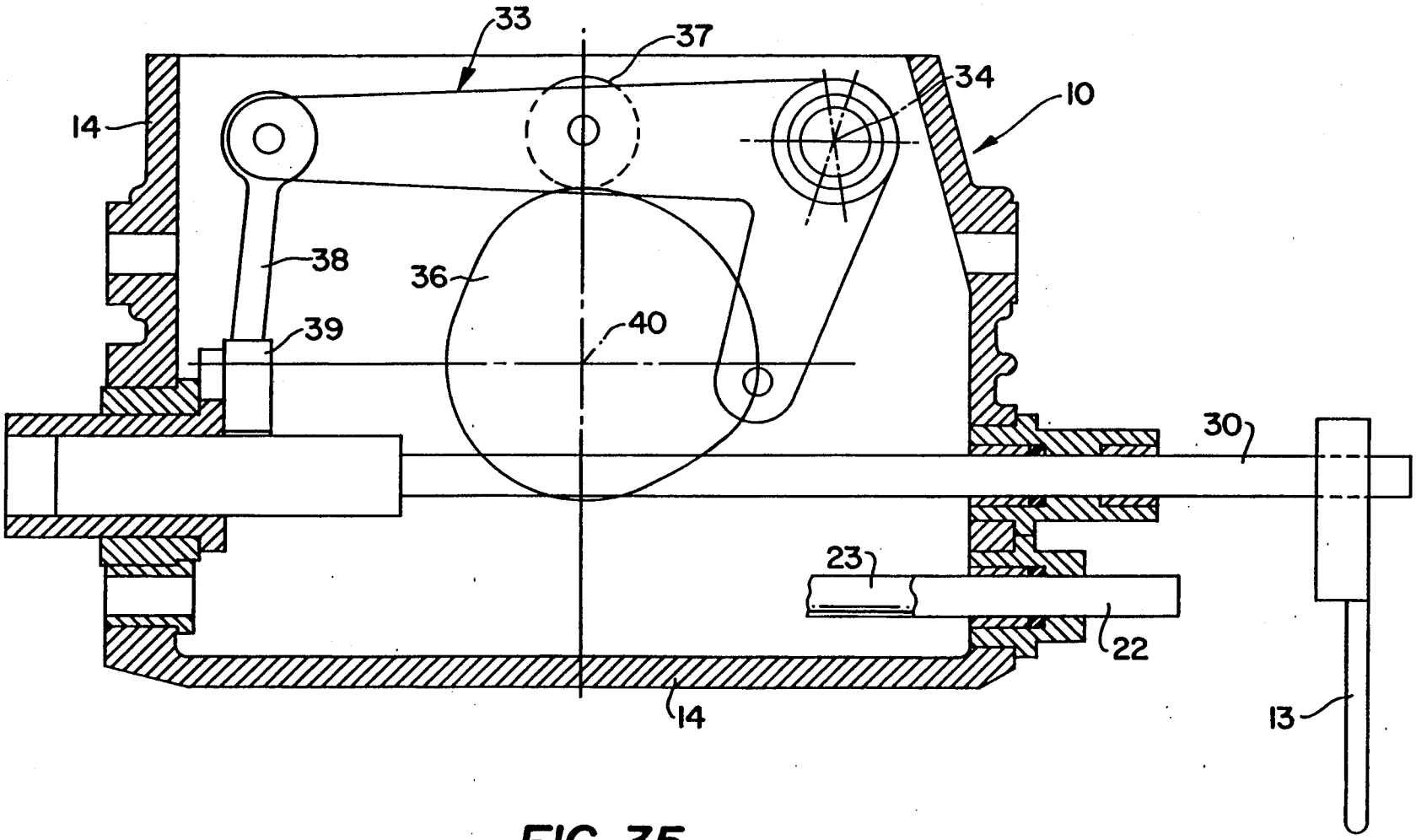
Figure 36:
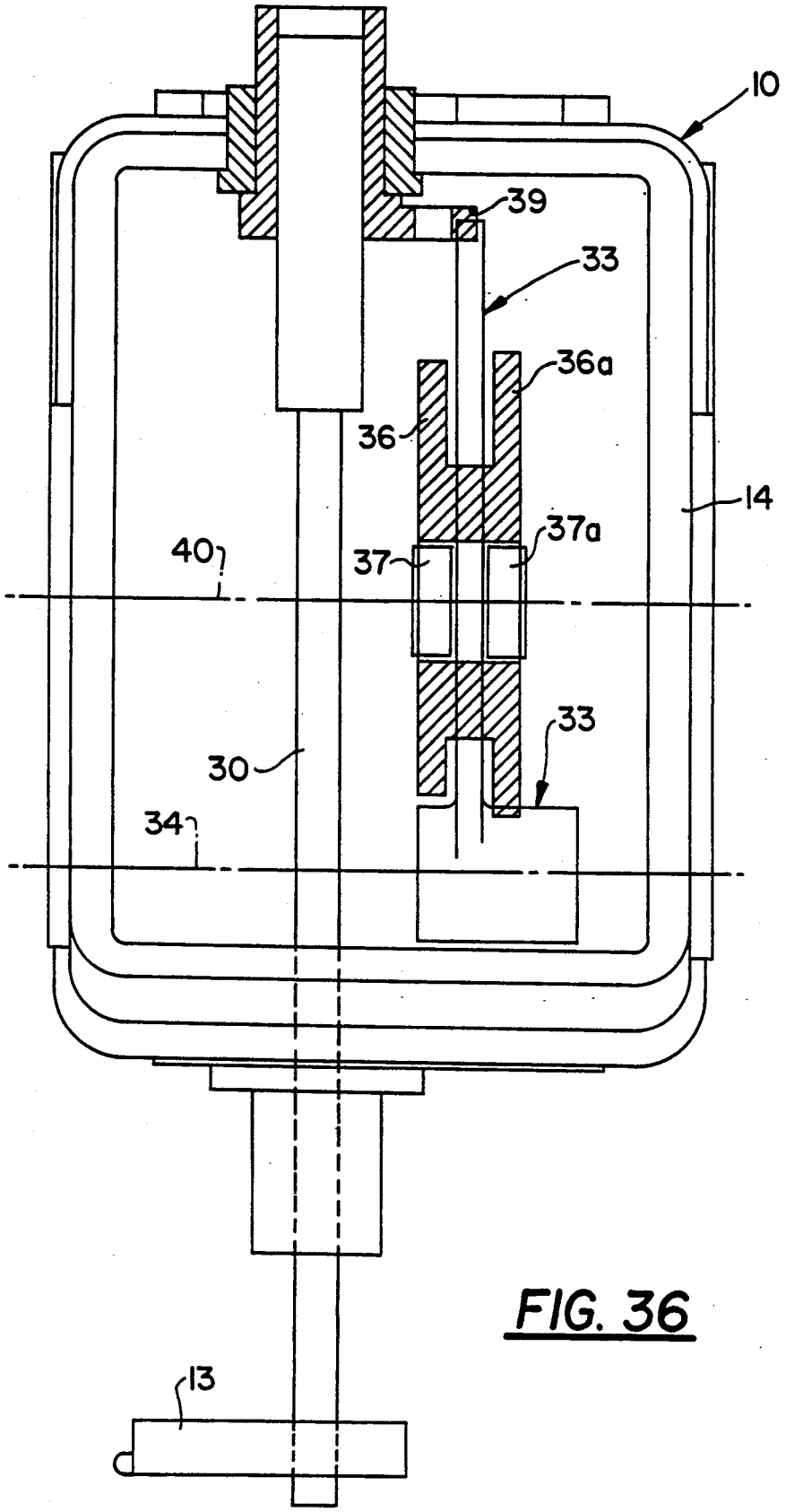
Figure 37:
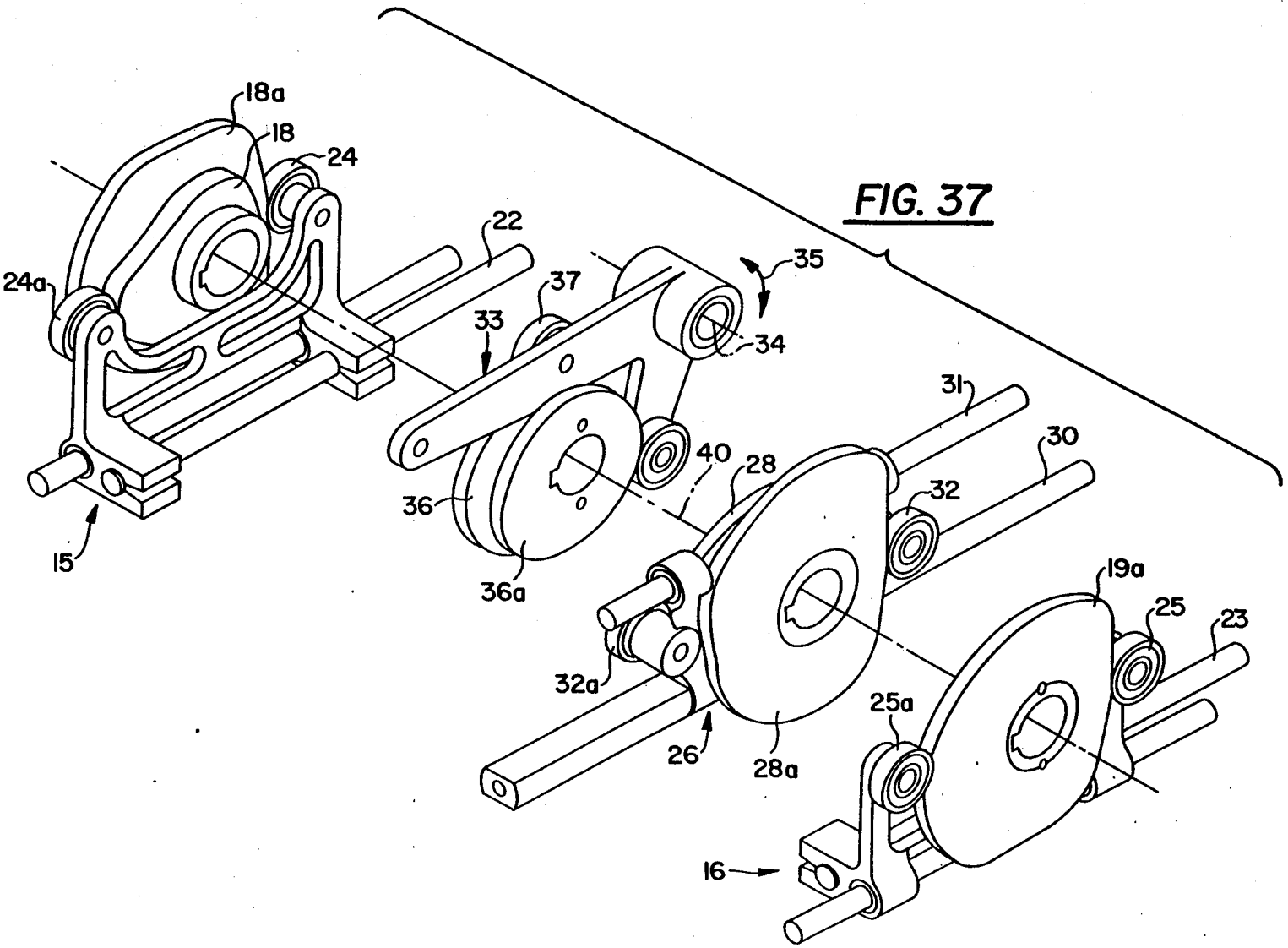
FIG. 37 is an exploded view of the mechanism for reciprocating the gripper, scissors and needle, and for rotating the needle of the selvedge-forming mechanism.

FIGS. 34–36 show in detail the end position of the needle 13.

The steps of moving down of the gripper 11, and of cutting of the pick by the scissors 12 are not shown in the drawings in detail, in that those steps take place in a way which is well known to those skilled in the art.

Due to this reason, not even the structure of the gripper 11-scissors 12 group—which does not fall within the scope of the present invention, and could be of any known types—is illustrated in detail.

By means of the above described structure, the purpose declared in the introductory portion of this specification, of providing a selvedge-forming mechanism, in which the means for gripping and cutting the pick, and the needle, are driven by means of an extremely simple kinematic drive link, with direct drive, i.e., without the presence of complex systems for operatively linking the motion supply shaft—which cause errors to occur during the motion transmission, and do not enable high operating speeds to be reached, owing to the large masses required and of the several components which constitute the kinematic motion transmission link—is thus achieved.

I claim:

1. A mechanism for forming a recessed selvedge on fabric being manufactured on a shuttleless loom which is operable to produce a shed which opens and closes as the fabric is being woven by the loom, said mechanism comprising:

means for gripping a thread inserted in the shed and means for cutting a thread inserted into the shed, so as to provide within the shed of a fabric being woven on a shuttleless loom, a cut pick having at a trailing end thereof a tail transversally protruding from the shed;

a needle arranged for capturing said tail and bending said cut pick back upon itself so that said tail is disposed with the shed; and a kinematic drive means for said gripping cutting means and for said needle, comprising:

a first carriage supporting said gripping means for reciprocating movement longitudinally of the fabric being woven;

a second carriage supporting said cutting means for reciprocating movement longitudinally of the fabric being woven;

a third carriage supporting said needle for reciprocating movement longitudinally of the fabric being woven;

a case arranged to be supported on a shuttleless loom;

means mounting said first, second and third carriages on said case for reciprocating longitudinally of the fabric being woven, with said third carriage being flanked by said first and second carriages;

a rotationally driven shaft journalled on said case and extending transversally of the fabric being woven;

first, second and third cam means mounted on said shaft for rotation therewith;

first rotary cam follower means journalled directly on said first carriage and operatively disposed in rotational, cam-following relation with said first cam means, for causing cyclical reversing reciprocation of said first carriage, and therefore of said gripping means longitudinally of the fabric being woven;

second rotary cam follower means journalled directly on said second carriage and operatively disposed in rotational, cam-following relation with said second cam means, for causing cyclical reversing reciprocation of said second carriage, and therefore of said cutting means longitudinally of the fabric being woven; and third rotary cam follower means journalled directly on said third carriage and operatively disposed in rotational, cam-following relation with said third cam means, for causing cyclical reversing reciprocation of said third carriage, and therefore of said needle longitudinally of the fabric being woven.

2. The mechanism of claim 1, said kinematic drive means further including:

a crank lever journalled to said case for cyclically reversing rotation about a pivot axis parallel to said driven shaft;

means operatively connecting said crank lever, distally of said pivot axis to said needle so that as said crank lever cyclically reversingly rotates about said pivot axis, said needle reversingly rotates relative to said third carriage about an axis which extends longitudinally of the fabric being woven;

said crank lever being interposed between said third carriage and one of said first and second carriages;

a fourth cam means mounted on said shaft for rotation therewith;

a fourth rotary cam means journalled directly on said crank lever and operatively disposed in rotational, cam following relation with said fourth cam means, for causing cyclical reversing rotation of said crank lever about said pivot axis, and therefor of said needle relative to said third carriage.

3. The mechanism of claim 1, wherein:

said first and second cam means each comprise a respective cam and, united therewith, a respective conjugate cam; and said first and second cam follower means each comprise two cam follower rollers respectively rollingly engaging the respective said cam and conjugate cam, generally from diametrically opposed locations in relation to the respective said cam means.

4. The mechanism of claim 1, wherein:

said third cam means comprises a cam and, united therewith, a conjugate cam; and said third cam follower means comprises two cam follower rollers respectively rollingly engaging the respective said cam and conjugate cam, generally from diametrically opposed locations in relation to the respective said cam means.

* * * * *